US010377528B2

(12) United States Patent
El Kawam

(10) Patent No.: US 10,377,528 B2
(45) Date of Patent: Aug. 13, 2019

(54) CLOSED POLYGONAL CELL SHIPPING PALLET

(71) Applicant: Haissam Haidar, Eugene, OR (US)

(72) Inventor: Ibrahim El Kawam, Eugene, OR (US)

(73) Assignee: Haissam Haidar, Eugene, OR (US)

( * ) Notice: Subject to any disclaimer, the term of this patent is extended or adjusted under 35 U.S.C. 154(b) by 0 days.

(21) Appl. No.: 16/011,297

(22) Filed: Jun. 18, 2018

(65) Prior Publication Data

US 2019/0031393 A1 Jan. 31, 2019

Related U.S. Application Data

(63) Continuation-in-part of application No. 15/658,834, filed on Jul. 25, 2017.

(51) Int. Cl.
*B65D 19/38* (2006.01)
*B65D 19/00* (2006.01)

(52) U.S. Cl.
CPC ..... *B65D 19/0018* (2013.01); *B65D 19/004* (2013.01); *B65D 2519/00034* (2013.01); *B65D 2519/00069* (2013.01); *B65D 2519/00139* (2013.01); *B65D 2519/00268* (2013.01); *B65D 2519/00273* (2013.01); *B65D 2519/00288* (2013.01); *B65D 2519/00303* (2013.01); *B65D 2519/00318* (2013.01); *B65D 2519/00338* (2013.01); *B65D 2519/00402* (2013.01); *B65D 2519/00407* (2013.01); *B65D 2519/00432* (2013.01); *B65D 2519/00437* (2013.01); *B65D 2519/00562* (2013.01)

(58) Field of Classification Search
CPC ..... B65D 2519/00034; B65D 2519/00303; B65D 2519/00358; B65D 2519/00388; B65D 2519/00517; B65D 19/18; B65D 19/0018
See application file for complete search history.

(56) References Cited

U.S. PATENT DOCUMENTS 3,695,168 A 10/1972 Granatstein
3,762,342 A * 10/1973 Lawlor ..... B65D 19/0018 108/53.3

(Continued)

FOREIGN PATENT DOCUMENTS

DE 102010009801 A1 11/2010
WO WO-9410051 A1 * 5/1994 ..... B65D 19/0012

OTHER PUBLICATIONS

Oxford Living Dictionary definition of "cylindrical" (Year: 2019).*

*Primary Examiner* — Matthew W Ing
(74) *Attorney, Agent, or Firm* — Mohr Intellectual Property Law Solutions, PC

(57) ABSTRACT

A method, system, apparatus, or device to support or move objects. The apparatus may include a substrate and a rib structure. The rib structure may be disposed at an interior portion of the substrate. The rib structure may include a first chamber extending downwardly from a first plane to a second plane. A wall of the first chamber may taper inwardly to form a first inverted dome. The rib structure may include a second chamber extending downwardly from the first plane to the second plane to form a second inverted dome. A wall of the second chamber may taper inwardly to form a first inverted dome.

18 Claims, 15 Drawing Sheets

(56) References Cited

U.S. PATENT DOCUMENTS

| | | | | |
|---|---|---|---|---|
| 5,142,994 | A * | 9/1992 | Sandberg | B27N 5/00 108/53.3 |
| 5,566,624 | A | 10/1996 | Brown et al. | |
| 6,357,366 | B1 | 3/2002 | Frankenburg | |
| 8,701,571 | B2 | 4/2014 | Grant | |
| 2012/0174834 | A1 | 7/2012 | Grant | |

* cited by examiner

CLOSED POLYGONAL CELL SHIPPING PALLET

CROSS-REFERENCE TO RELATED APPLICATION

This application is a continuation-in-part of application Ser. No. 15/658,834, filed 25 Jul. 2017.

BACKGROUND

The present disclosure relates generally to shipping pallets. In particular, shipping pallets with unique polygonal internal closed cell structures, utilizing arched filleted legs and single piece molding are described.

Shipping pallets are designed and built to protect and ship loads and help to make those loads more easily stacked and moved. Known shipping pallets are not entirely satisfactory for the range of applications in which they are employed. For example, most existing shipping pallets are made of wood and represent a highly inefficient use of lumber and natural resources. Most wood shipping pallets do not last longer than a year, and with nails embedded in the wood, end up in landfills instead of being reused or recycled. Additionally, wood shipping pallets have a limited load weight before breaking. Wood shipping pallets cannot be used for certain types of goods as well. For example, they cannot be used for certain types of produce or food products because they cannot withstand the elements like water and cold, which the food products must be subjected to in order to keep longer. Current pallets are not fireproof, weatherproof, chemical resistant, and do not adequately distribute uneven or large weights.

Thus, there exists a need for shipping pallets that improve upon and advance the design of known shipping pallets. Examples of new and useful shipping pallets relevant to the needs existing in the field are discussed below.

SUMMARY

A method, system, apparatus, or device to support or move objects. The apparatus may include a substrate. The apparatus may include a rib structure that may be disposed at an interior portion of the substrate. The rib structure may include a first chamber extending downwardly from a first plane to a second plane. A wall of the first chamber may taper inwardly to form a first inverted dome. The rib structure may include a second chamber extending downwardly from the first plane to the second plane to form a second inverted dome. A wall of the second chamber may taper inwardly to form a first inverted dome.

BRIEF DESCRIPTION OF THE DRAWINGS

The present description will be understood more fully from the detailed description given below and from the accompanying drawings of various embodiments of the present embodiment, which is not to be taken to limit the present embodiment to the specific embodiments but are for explanation and understanding.

DETAILED DESCRIPTION

Figure 1:
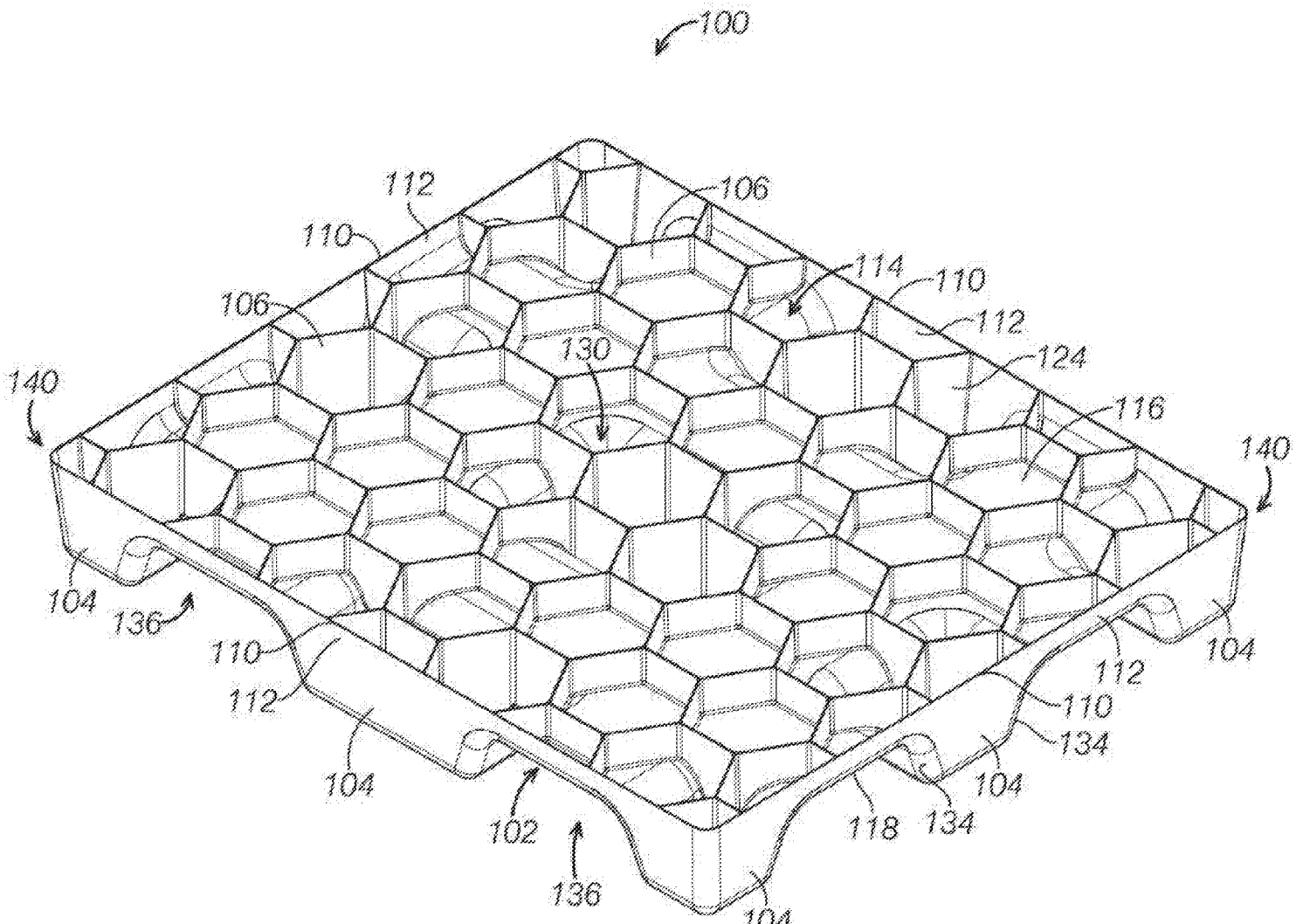
FIG. 1 is a perspective view of a first example of a shipping pallet with unique polygonal internal closed cell structures.

The disclosed shipping pallets will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various shipping pallets are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

The present disclosure is directed to a shipping pallet with a single-piece base, where the base is a substantially planar substrate with a top side and a bottom side. The pallet includes a plurality of legs formed from depressions in the substrate, and each leg protrudes from the bottom side of the substrate in an arcuate fashion. A plurality of partitions are disposed normally from the top side of the substrate with each partition smoothly meeting the substrate in an arcuate fashion. A lid is configured to fit atop the single-piece base covering the plurality of partitions to form a closed polygon cell system.

In some examples of the pallet, the plurality of partitions is a patterned rib structure made of polygonal shapes. The polygonal shapes are primarily any polygonal shape with a number of sides in a range from four sides to twenty sides. In some examples, the polygonal shapes primarily include a hexagonal shape. In other examples, the polygonal shape primarily includes a pentagonal shape. Still, in other examples, the polygonal shape primarily includes an octagonal shape.

The shipping pallet may have the plurality of legs formed from depressions in the substrate such that each of the legs are hollow. In this example, the plurality of partitions extend into the legs which are hollow and smoothly meet the top of the substrate inside the hollow legs in an arcuate fashion.

The shipping pallet may be a single piece base that is formed by a single injection molding process.

Further, in some examples, the depressions of the legs form an angle with the bottom of the substrate. The angle is obtuse and the depressions of the legs and the substrate form a flattened domed structure to effectively transfer weight.

In alternate examples of the shipping pallet, the shipping pallet may include a substrate with a top side and bottom side. There may be a plurality of legs formed from the substrate that protrude from the plane of the substrate normal to the bottom side, thereby creating corresponding depressions in the top side of the substrate. A rib structure may be disposed on the top side of the substrate that meets the substrate in an arcuate fashion. The rib structure may be a series of polygonal shapes and cover substantially all of the top side of the substrate, with the rib structure extending into the depressions created by the plurality of legs.

In some examples, the polygonal shapes are primarily any polygonal shape with a number of sides in a range from four sides to twenty sides. For some examples, the polygonal shapes primarily include a hexagonal shape. In other examples, the polygonal shape primarily includes a pentagonal shape. Still, in other examples, the polygonal shape primarily includes an octagonal shape. In these examples, the rib structure extends into the depressions created by the plurality of legs and smoothly meets the top side of the substrate in an arcuate fashion.

The shipping pallet, the substrate, the plurality of legs, and the rib structure may be formed by a single injection molding process.

In some examples, the polygonal shapes have a width, where the width is a minimum of four inches in diameter.

The shipping pallet may also include a lid, where the lid is configured to fit atop the rib structure covering the rib structure to form a closed polygon cell system.

In other examples of a shipping pallet, the shipping pallet may include a single-piece base, where the base includes a substantially planar substrate with a top side and a bottom side. It may include a plurality of legs formed from depressions in the substrate such that each leg protrudes from the bottom side of the substrate in an arcuate fashion. There may be a plurality of chambers formed on the top side of the substrate where each chamber includes a plurality of chamber walls to create the chamber. Each chamber wall smoothly meets the substrate in an arcuate fashion. There may also be a lid configured to fit atop the single-piece base covering the plurality of chambers to form a closed polygon cell system. The chambers may have a diameter where the diameter may be in a range from four inches to sixteen inches.

The shipping pallet uses the latest in high-end software and engineering to create a shipping pallet that outperformed most of its contemporaries and provides a needed product for most. The beneficial physical and chemical properties of plastics led to its use with the shipping pallet rather than wood, as further explained later. Upon researching, thinking, testing and taking inspiration from engineering concepts, the current pallet was created. The shipping pallet, with its significantly reduced weight when considering its load metrics, with a repeating internal structure, along with other structural and material features, creates a new market worthy shipping pallet.

With reference to FIGS. 1-6, a first example of a shipping pallet with unique polygonal internal closed cell structures, utilizing arched filleted legs and single piece molding, shipping pallet 100, will now be described. Shipping pallet 100 functions to effectively hold and move loads while evenly distributing weight, and being resistant to the elements, fire, chemicals, and general wear and tear. The reader will appreciate from the figures and the description below that shipping pallet 100 addresses shortcomings of conventional shipping pallets.

For example, shipping pallet 100 is uniquely structured and manufactured that has a best weight to strength ratio. It includes areas to be lifted by a forklift or straps, and is a standard four-sided pallet of a standard size of forty by forty-eight inches wide, and between five and ten inches in height. The shipping pallet includes a unique design to have a high weight-to-strength ratio and is similar in weight to the standard wood pallet. It is highly cost-effective and easy to manufacture using an injection molding process. Because it is made from plastic, the shipping pallet is fireproof, chemical resistant, element resistant, durable, impact resistant, and can increase the life of the pallet from the standard one year to between three and five years. The internal polygon closed cell structure is easy to make and manufacture, but will last longer and is even recyclable.

As shown in FIGS. 1-6, shipping pallet 100 includes a base 102, legs 104, and partitions 106. In some examples of the shipping pallet 100, the shipping pallet 100 may also include a lid 108. Shipping pallet 100 utilizes a six-sided internal cell structure to create chambers that may support a load, making storage and transport of goods easy and reliable. In other examples, the shipping pallets include additional or alternative features, such as four-sided, five-sided, eight-sided, or twenty-sided internal cell structure.

As can be seen in FIG. 1, the base 102 of the shipping pallet may be a planar sheet of sturdy material that may include legs and partitions extending from it. In this example embodiment, the base 102 may be a substantially rectangular sheet of plastic, where the base includes four edges 110. The base 102 may also be a substrate, providing an underlying surface for features to protrude from. Along the edges 110 of the base 102, base walls 112 may protrude upward from the base to enclose an inner area 114 of the base 102. The base walls 112 may be of a suitable height to allow for the inclusion of partitions in the inner area 114 and may be a large range in height based on needs of specific shipments. The inner area 114 may be a space contained within the shipping pallet 100 that is substantially void of material. The inner area 114 may contain within it partitions, ribs, walls, or other supporting structures that give the pallet strength and rigidity. In alternate examples of the shipping pallet 100, the inner area 114 may contain a lightweight strengthening material, such as hard foam, to fill the space of the inner area 114 and provide strength and rigidity to the shipping pallet 100.

As seen in FIG. 1, the base 102 may further include a top side 116 and a bottom side 118. The top side 116 may be a surface of the base 102 bordered by the edges 110. The top side 116 may provide a surface from which partitions or ribs may extend. The top side 116 may also provide a surface for supporting structures that may be contained within the inner area 114 of the shipping pallet 100. The bottom side 118 may similarly provide a surface for legs to extend from. The bottom side 118 may also provide a surface to support the shipping pallet 100 and allow the shipping pallet 100 to be lifted, transported, or stacked.

Still, in reference to FIG. 1, the shipping pallet 100 may include a plurality of legs 104 extending from the bottom side 118 of the base 102. The legs 104 may lift or elevate the bottom side 118 of the base 102 away from a floor or other supporting surface that the shipping pallet 100 may be placed on. The legs 104 may be spaced away from one another, leaving gaps between the legs 104 to allow for a forklift fork, strap, hand, or other device or part to be inserted underneath the shipping pallet 100 to allow for easy lifting and transportation of goods. As shown in FIG. 1, the plurality of legs 104 may be formed from depressions in the base 102 of the substrate such that each leg 104 protrudes from the bottom side 118 of the base 102 of the substrate in an arcuate fashion. The legs 104 may be formed at the same time as the base 102 during an injection molding process. In this example embodiment, depressions in the base 102 of the substrate also affect the top side 116 of the base 102 of the substrate, where the top side 116 forms a hollow depression 130 in the top side 116 of the base 102 in the inner area 114.

Figure 2:
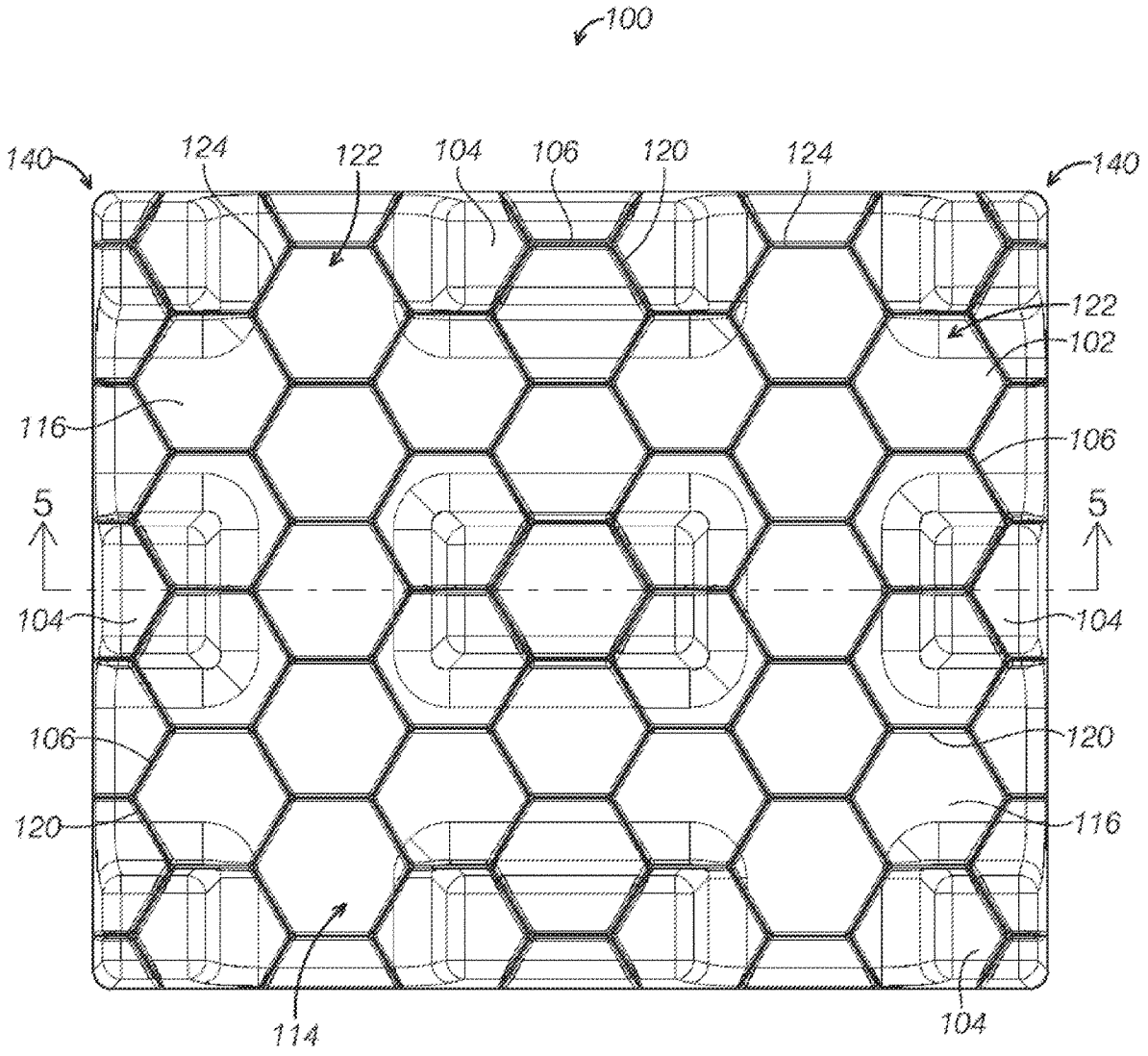
FIG. 2 is a top plan view of the shipping pallet shown in FIG. 1 depicting a hexagonal internal chamber pattern.

Still as seen in FIG. 1, and as better exemplified in FIG. 2, the shipping pallet 100 may further include one or more partitions 106. The partitions 106 separate or divide the inner area 114 of the shipping pallet 100 into different chambered areas, and may provide significant strength and rigidity to the shipping pallet while adding minimal weight and mass. The partitions 106 are positioned to transfer weight that may be placed on the shipping pallet 100 through the partitions 106 and into the base 102 and legs 104. This transfer of weight allows the shipping pallet 100 to carry much larger weights and loads than a traditional wood pallet while remaining lightweight and easily manufacturable. In manufacturing, the partitions 106 may be formed at the same time as the rest of the shipping pallet 100, including the base 102 and legs 104, in a single injection molding process such that the base 102, legs 104, and partitions 106 are integrally formed. Alternatively, the partitions 106 may be formed separately from the base 102 and legs 104 and attached to the base 102 in an after manufacturing process.

As seen in FIGS. 1 and 2, the partitions 106 may further or alternatively be described as ribs 120, where the ribs 120 extend from the top side 116 of the substrate or base 102. The partitions 106 or ribs 120 may be disposed normally from the top side 116 of the substrate or base 102 and may be a patterned partition or rib structure forming polygonal shapes. In this example embodiment, the partitions 106 or ribs 120 are disposed normally in a hexagonal structure, where the partitions 106 or ribs 120 form a series of hexagons or six-sided shapes. In alternate embodiments, the polygonal shape may be any polygonal shape with a number of sides in a range from four sides to twenty sides, including a hexagonal shape, pentagonal shape, octagonal shape, or a combination of polygonal shapes.

As shown in FIGS. 1 and 2, chambers or cells may be formed by the partitions 106 or ribs 120 and may form a closed polygonal cell system that contributes to its lightweight structure and increased strength. The chambers or cells contribute to a sturdy structure to support any material goods placed on top of the shipping pallet 100 while only adding minimal weight to the shipping pallet 100. In this example embodiment, the partitions 106 or ribs 120 interconnect between the top side 116 of the base 102, the base walls 112, and between themselves to partition off individual cell structures or chambers 122. The inner area 114 may be filled with one or more chambers 122 that are bordered by the top side 116 of the base 102 of the substrate and the partitions 106, ribs 120, or base walls 112.

As can be seen in FIG. 2, each chamber 122 may be shaped by the partitions 106, where the partitions 106 form chamber walls 124, which may form a polygonal shape. In this example embodiment, the chamber walls 124 of the chambers 122 form a hexagonal or six-sided shape, with other irregularly shaped polygonal shapes formed near the edges 110 of the shipping pallet 100. Each chamber may include a diameter as measured from one partition 106 or rib 120 to an opposing partition 106 or rib 120 across a center of the chamber 122. In this example embodiment, the chambers 122 each may have a diameter of approximately six to eight inches. In alternate embodiments, the chambers may have a diameter as small as four inches, or as large as sixteen inches. As the chamber diameter increases, there is a decrease in rigidity and strength of the pallet and a decrease in overall weight. Conversely, as the diameter decreases, there is an increase in rigidity and strength of the pallet and an increase in overall weight. The difference in weight and strength may be desirable for different applications. For example, a smaller diameter chamber may be used for larger or heavier materials to be shipped on the shipping pallet. Alternatively, a larger diameter chamber may be used for lighter or smaller materials.

Figure 3:
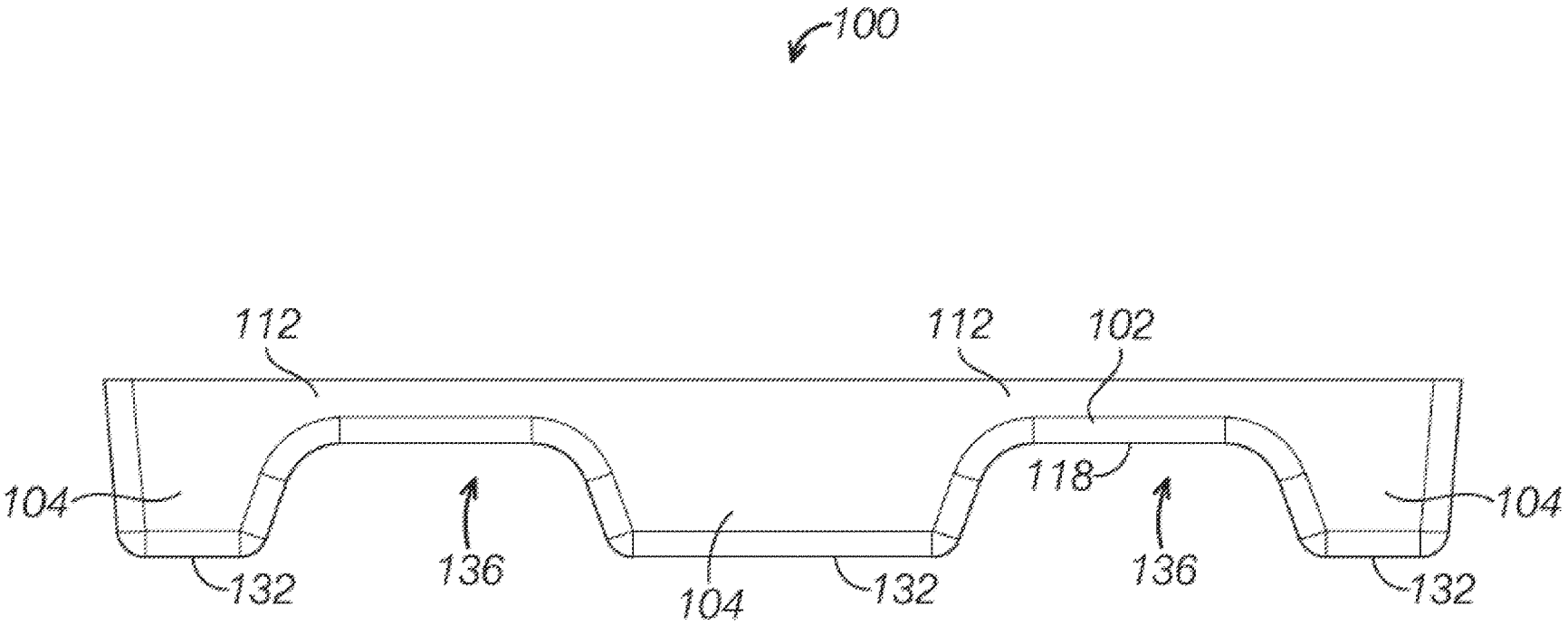
FIG. 3 is a front elevation view of the shipping pallet shown in FIG. 1 depicting arched filleted legs creating a flat domed structure.

Turning now to FIG. 3, the shipping pallet 100 may include a plurality of legs 104 that extend from the bottom side 118 of the base 102 of the substrate. The legs 104 of the shipping pallet 100 function to transfer the load placed on top of the shipping pallet 100 to the ground, as well as elevate or raise the load above the ground to allow for easier transportation of the pallet and load. The plurality of legs 104 may be formed from depressions in the base 102 of the substrate such that each leg 104 protrudes from the bottom side 118 of the base 102 of the substrate in an arcuate fashion and is hollow. The legs 104 may be formed at the same time as the base 102 during an injection molding process.

As shown in FIG. 3, the legs 104 may include a bottom portion or surface area that may contact the ground, floor, or other pallets or material. In this example embodiment, the legs bottoms 132 are located on a bottom surface of the legs and make contact with the ground. Angled upward from the legs bottoms 132 may be legs walls 134, which may be angled negatively from the legs bottoms 132 such that an obtuse angle is formed between the legs bottoms 132 and the legs walls 134. The legs walls may rise away from the ground and elevate the bottom side 118 of the base 102 above the ground or plane of the legs bottoms 132. The legs walls 134 may join with the bottom side 118 of the base 102, forming an obtuse angle between the legs walls 134 and the bottom side 118. Additionally, the legs walls 134 may join with the base 102 in an arcuate fashion, where the transition from the legs walls 134 to the bottom side 118 of the base smoothly transitions without angles, in an arc or domed fashion.

As shown in FIG. 3, the legs 104 may be spaced apart from each other such that a space or void is between each leg 104 and above the ground or floor and below the bottom side 118 of the base 102. Forming this space or void may be a flattened domed structure 136. In this example embodiment, a flattened domed structure 136 may be formed by the legs walls 134 as they angle upwards and arcuately transition into the bottom side 118 of the base 102. The flattened domed structure 136 functions to effectively transfer weight from a load on the shipping pallet 100 from the lid, through the partitions 106, ribs, 120, and chambers 122 into the base 102 and legs 104. The arcuate fashion of the domed structure 136 more effectively distributes and transition force from a load than would a point or angle.

Figure 4:
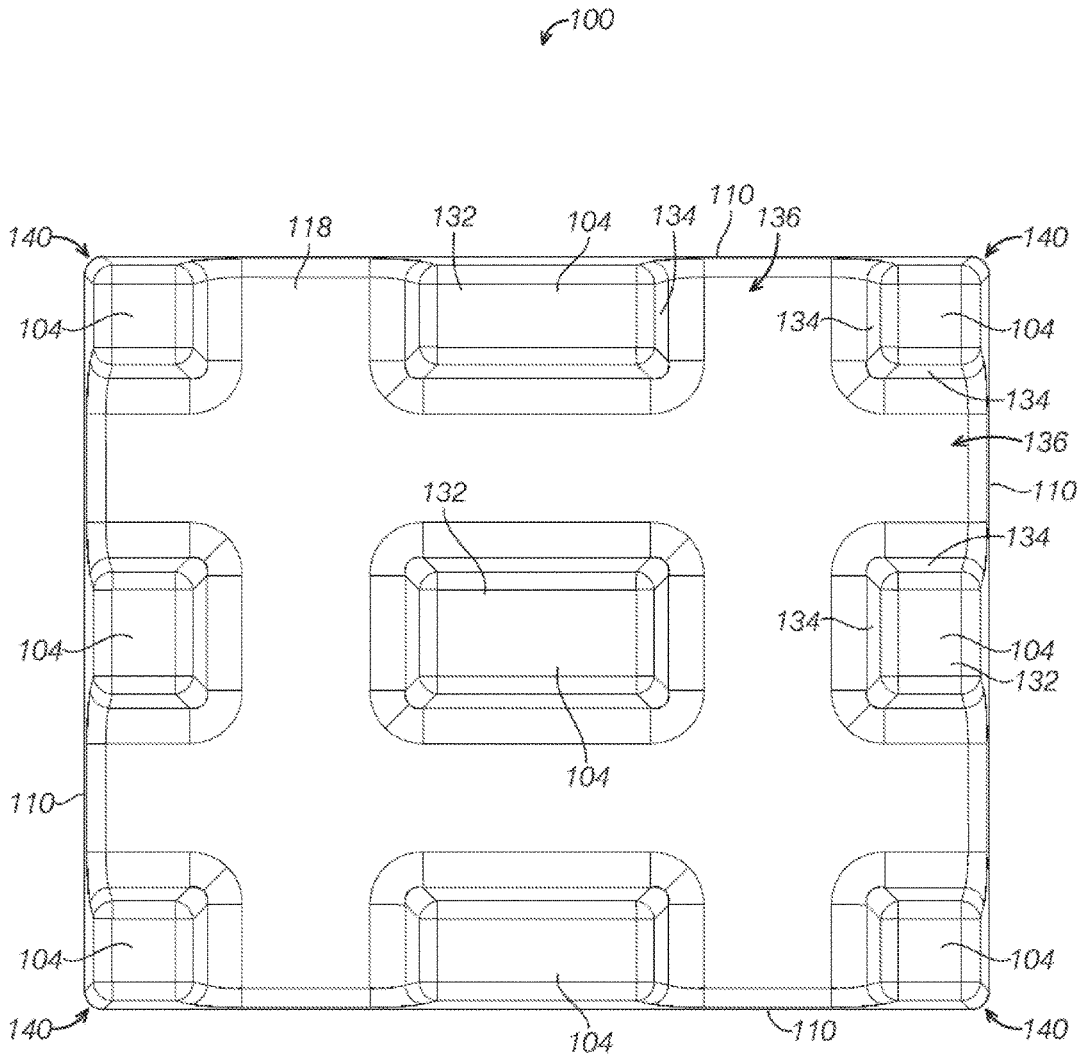
FIG. 4 is a bottom plan view of the shipping pallet shown in FIG. 1 depicting a pattern for the legs.

Turning now to FIG. 4, the legs 104 of the shipping pallet 100 may be spaced apart from each other in a normal pattern. In this example embodiment, nine legs 104 are spaced in a normal grid fashion on the bottom side 118 of the base 102. There is a leg 104 positioned at each of the four corners 140 of the shipping pallet 100. Additionally, there is a leg 104 positioned at an approximate center of each of the four edges 110 of the shipping pallet 100. A single leg 104 is positioned in an approximate center of the base 102 of the shipping pallet 100. The legs 104 are positioned in a normal grid fashion to allow the forks of a forklift or hand lift to slidingly enter underneath the shipping pallet 100 fully, utilizing the spaces or voids formed by the flattened domed structure 136. The legs walls 134 elevate the base 102 away from the floor or ground to create a void underneath the flattened domed structure 136 and with the legs 104 aligned in a normal grid fashion, allow the forks of a forklift to be fully inserted underneath the shipping pallet 100 for easy lifting and transport.

Figure 5A:
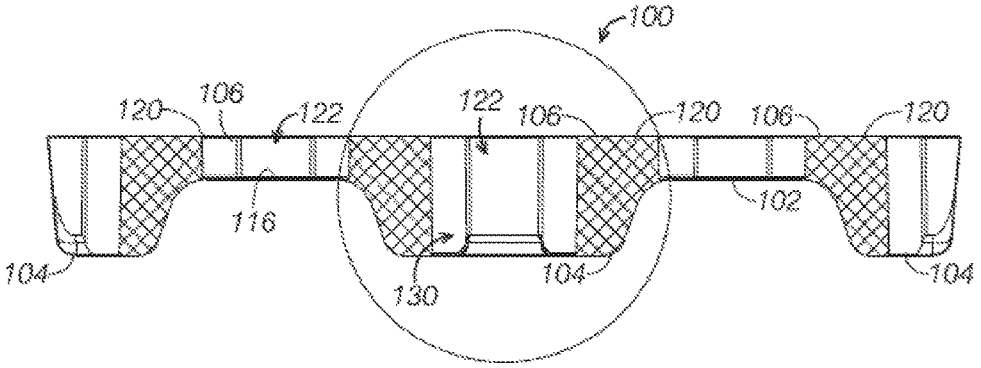
FIG. 5A is a cross-sectional view of the shipping pallet shown in FIG. 1 depicting the internal structures extending into the legs.
Figure 5B:
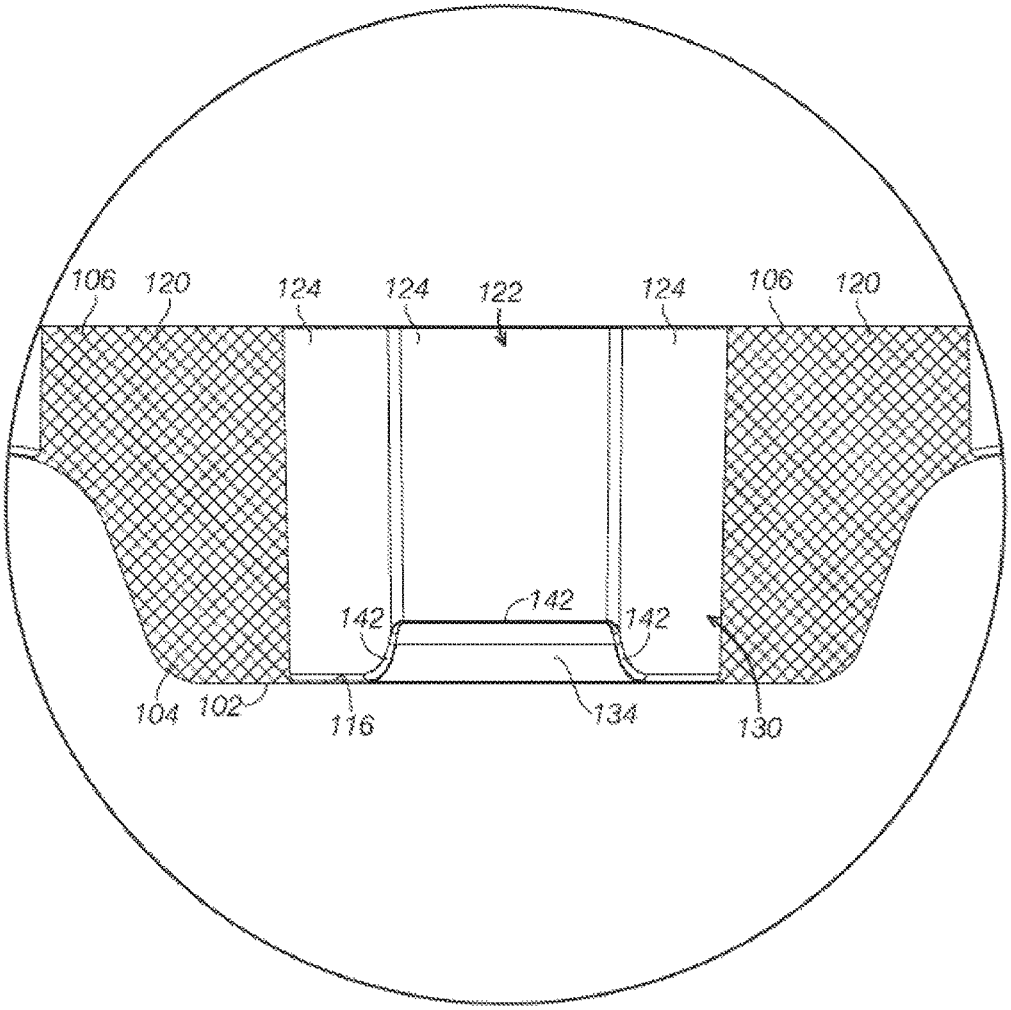
FIG. 5B is a zoomed in view of the cross-sectional view of the shipping pallet shown in FIG. 1, depicting the partitions joining the substrate in arcuate fashion.

Turning now to FIGS. 5A and 5B, a cross-section of the shipping pallet 100 shows that the partitions 106 or ribs 120 may extend into the hollow depressions 130 of the legs 104, which may provide further rigidity and stability to the shipping pallet 100. As exemplified in FIG. 5A, the partitions 106 or ribs 120 may extend upward from the top side 116 of the base 102 of the substrate. In addition, the partitions 106 or ribs 120 may extend upward and through the hollow depressions 130 formed by the hollow legs 104, such that the partitions 106 or ribs 120 may form closed chambers 122 or cells at any part of the shipping pallet 100, including in the legs 104.

As exemplified and shown in FIG. 5B, the partitions 106 or ribs 120 may extend fully into the hollow depression 130 of the leg 104 to create a closed cell or chamber 122. The partitions 106 or ribs 120 may form chamber walls 124 that extend from the top side 116 of the base 102 of the substrate and may extend to a top of the shipping pallet 100 to join with a lid. The partitions 106 or ribs 120 remain in contact and are connected or adhered to top side 116 of the legs walls 134 as the depression 130 deepens to form the hollow legs 104. The chamber walls 124 may be disposed normally from the top side 116 of the base 102 of the substrate, with each partition 106 or rib 120 smoothly meeting the substrate in an arcuate fashion at rib connections 142. The rib connections 142 smoothly transition from the top side 116 surface to the partitions 106 or ribs 120 by utilizing a radius or smooth curve in an arcuate fashion. The arcuate fashion in which the partitions 106 or ribs 120 connect with the base 102 functions to more efficiently transfer the forces caused by a load on the shipping pallet 100 to the ground or floor. This efficient transfer of force allows the shipping pallet 100 to carry more weight or larger loads more efficiently than a traditional pallet, and without adding extra mass or weight to the shipping pallet 100.

Figure 6:
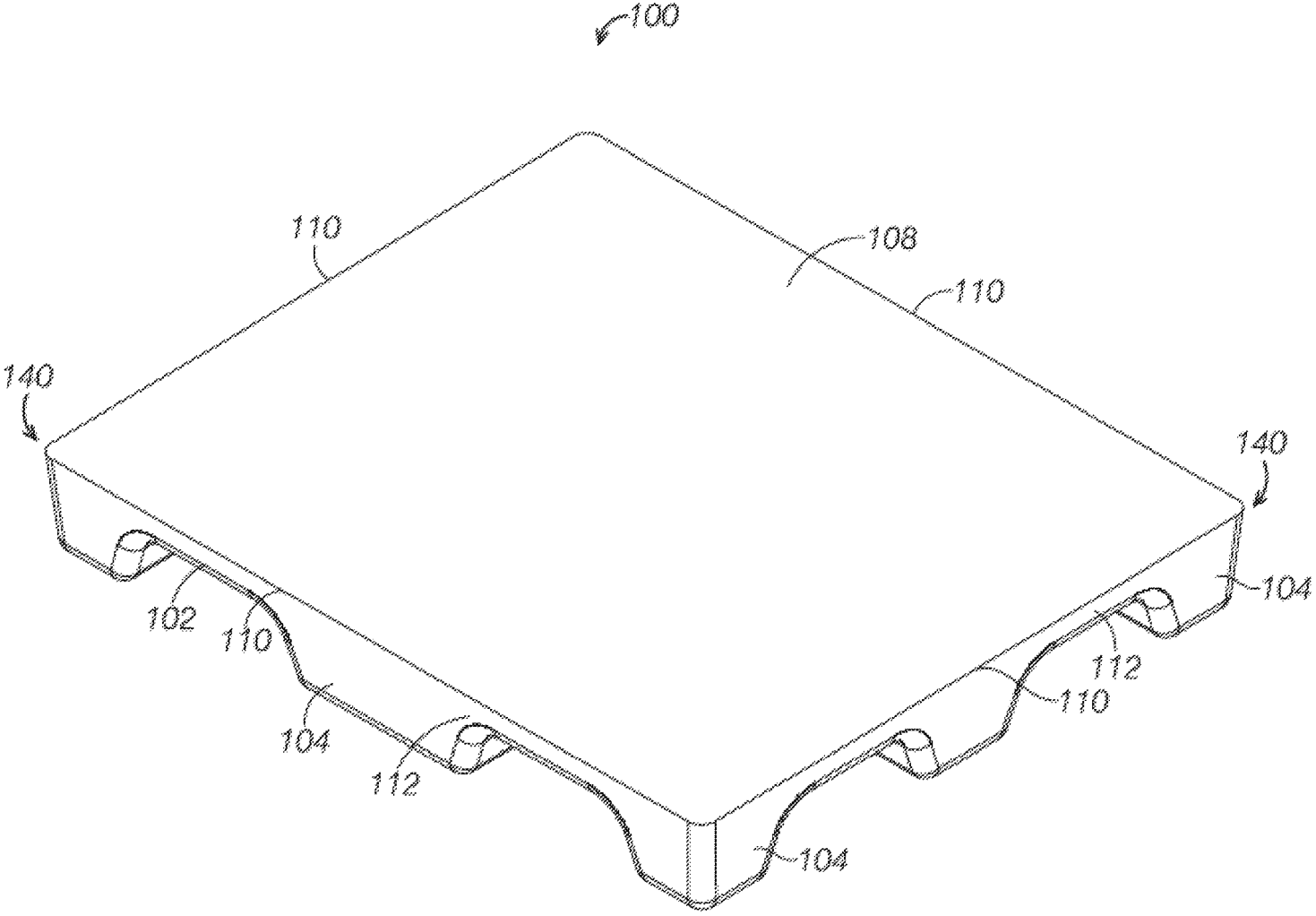
FIG. 6 is a perspective view of the shipping pallet shown in FIG. 1 depicting the shipping pallet with a lid.

Now turning to FIG. 6, a lid 108 may be placed on or adhered to the top of the shipping pallet 100 to form a closed cell shipping pallet with internal chambers. The lid 108 may be formed in a separate manufacturing process than that of the shipping pallet 100 and may be placed on top of or adhered to the shipping pallet 100 in an after manufacturing process. Alternatively, the lid may be produced and affixed to the shipping pallet 100 at the same time in the same manufacturing process. In this example embodiment, the lid 108 is configured to fit atop the single piece base 102 covering the plurality of partitions 106 or ribs 120 to form a closed polygon cell system. The closed polygon cell system may be formed when the lid seals the chambers 122 or cells such that each chamber 122 or cell is fully separate from other chambers 122 or cells in the inner area 114 of the shipping pallet 100. The lid 108 may fit fully over top of the shipping pallet 100 such that the lid 108 extends between the edges 110 of the shipping pallet 100 and connects or adheres to the base walls 112. Alternatively, the lid 108 may fit around the base walls 112, or fit into the base walls 112, to form a closed polygon cell system. The lid 108 functions to keep material and debris out of the inner area 114 of the shipping pallet 100. The lid 108 may also function to distribute the weight of a load placed on the shipping pallet 100 more evenly between the partitions 106 or ribs 120 on the inner area 114 of the shipping pallet 100.

Turning attention to FIGS. 7-10, alternate examples of a shipping pallet with unique polygonal internal closed cell structures, utilizing arched filleted legs and single piece molding, are shown and will be described. These alternate examples include many similar or identical features to shipping pallet 100. Thus, for the sake of brevity, each feature of the alternate embodiments will not be redundantly explained. Rather, key distinctions between the alternate examples and shipping pallet 100 will be described in detail and the reader should reference the discussion above for features substantially similar between the two shipping pallets. The alternate example shipping pallets may include many alternate configurations and shapes. For example, the shipping pallet may be a rectangular, square, or other polygonal shape. Alternatively, the shipping pallet may include differing and alternate internal partition, rib, or chamber shapes or structures.

Figure 7:
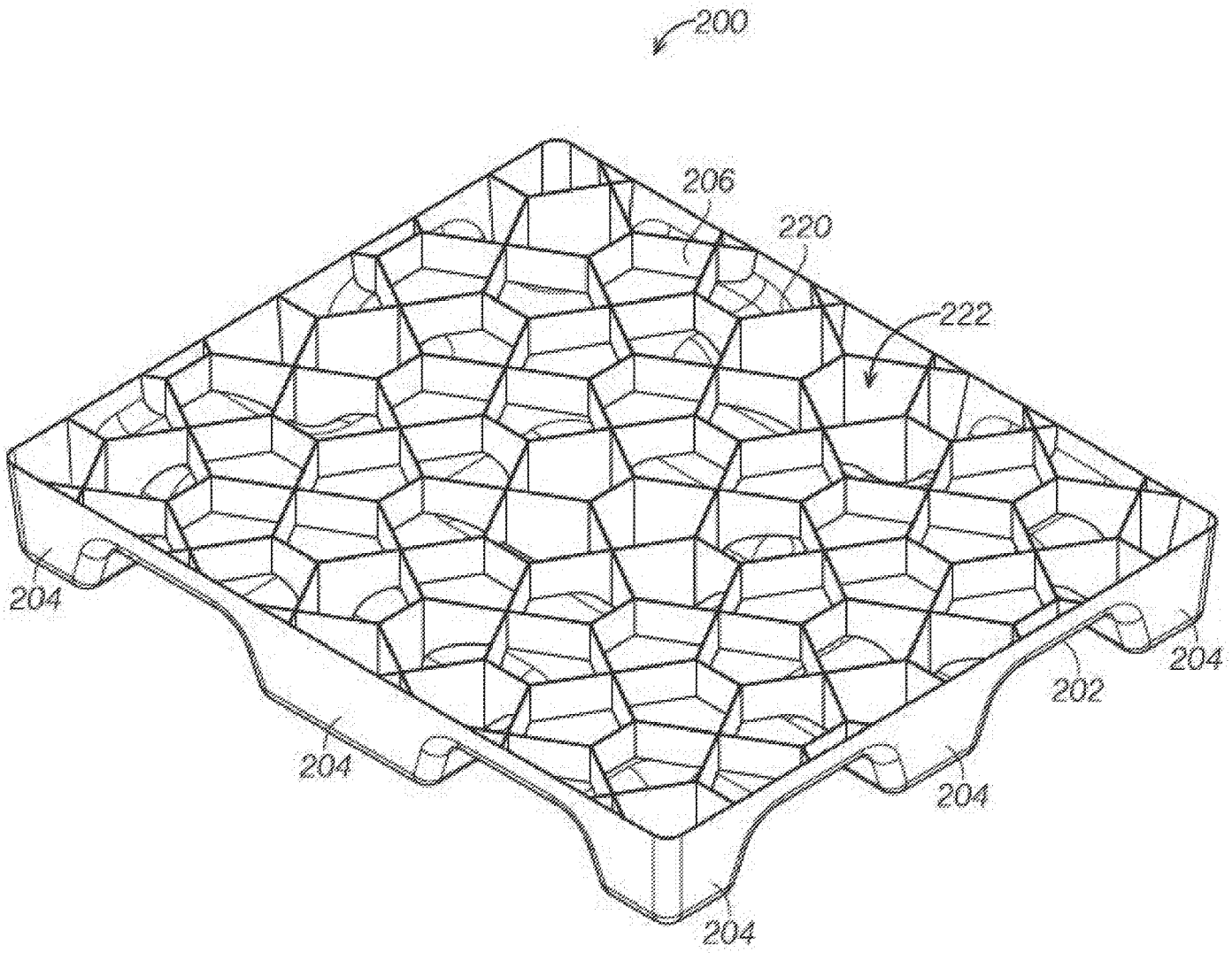
FIG. 7 is a perspective view of a second example of a shipping pallet including a five-sided internal cell structure.

Turning to FIG. 7, a second example of a shipping pallet with unique polygonal internal closed cell structures, utilizing arched filleted legs and single piece molding, shipping pallet 200, will now be described. Shipping pallet 200 functions to distribute the weight of a load placed on the shipping pallet 200 utilizing alternate chambers and partition designs. As shown in FIG. 7, shipping pallet 200 includes a base 202, legs 204, and partitions 206 or ribs 220. Shipping pallet 200 utilizes a five-sided internal cell structure to create chambers 222 that may support a load, making storage and transport of goods easy and reliable. A five-sided chamber 222 formed by partitions 206 or ribs 220 may be desirable when a larger or heavier load is placed on the shipping pallet. The five-sided internal cell structure of shipping pallet 200 may give the shipping pallet 200 unique strength characteristics that alternate polygonal internal cell structures do not provide. The increase in partitions may also make shipping pallet 200 heavier than an alternate polygonal internal cell structure shape.

Figure 8:
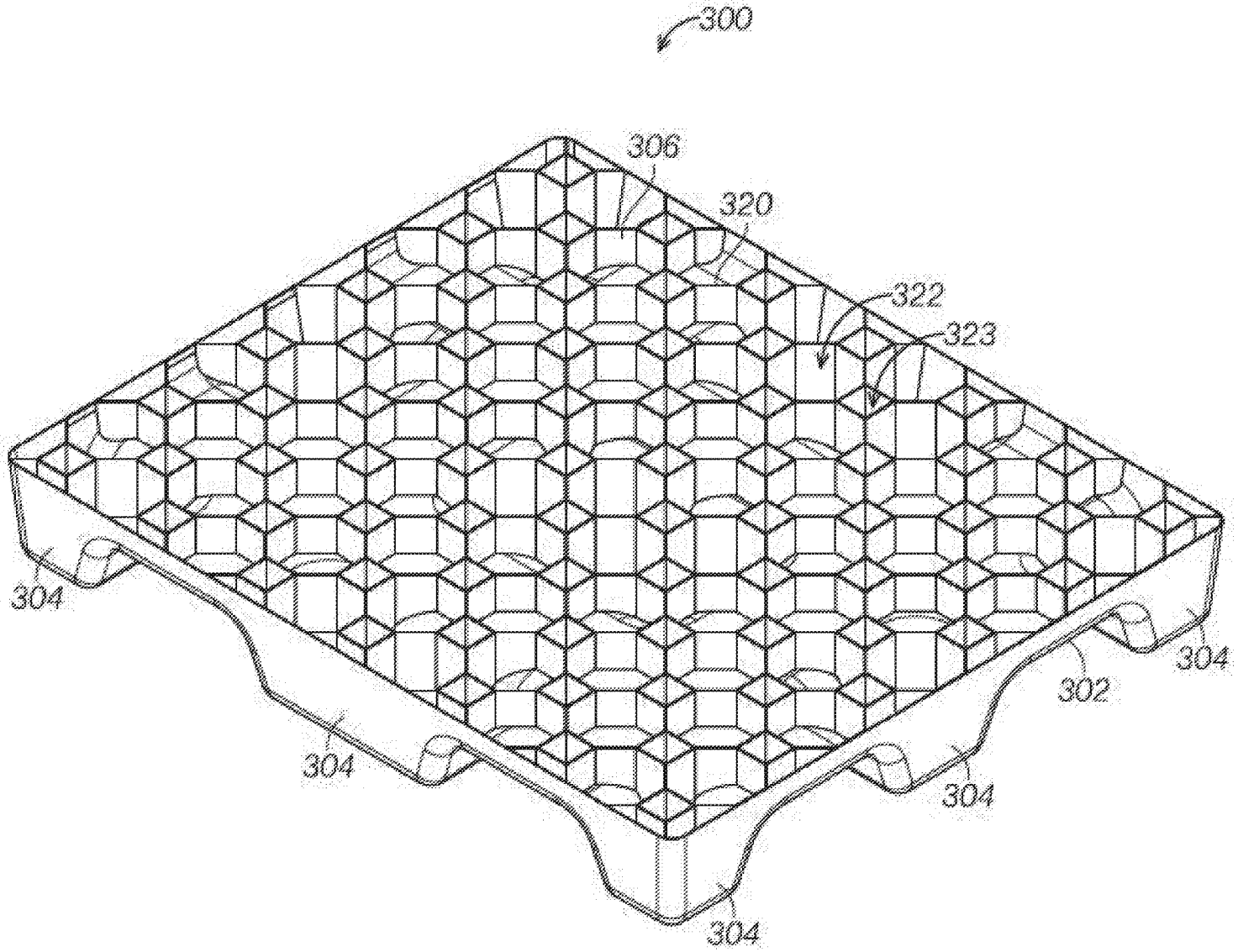
FIG. 8 is a perspective view of a third example of a shipping pallet including an eight-sided internal cell structure.

Turning to FIG. 8, a third example of a shipping pallet utilizing multiple different and unique polygonal internal closed cell structures, shipping pallet 300, will now be described. Shipping pallet 300 functions to distribute the weight of a load placed on the shipping pallet 300 utilizing multiple different polygonal chambers and partition designs. As shown in FIG. 8, shipping pallet 300 includes a base 302, legs 304, and partitions 306 or ribs 320. Shipping pallet 300 primarily utilizes an eight-sided internal cell structure, with intermittent four-sided cell structures, to create eight-sided chambers 322 and four-sided chambers 323 that may support a load, making storage and transport of goods easy and reliable. An eight-sided chamber 322 with four-sided chambers 323 intermittent, formed by partitions 306 or ribs 320, may be desirable when a larger or heavier load is placed on the shipping pallet. The eight-sided internal cell structure with intermittent four-sided cells of shipping pallet 300 may give the shipping pallet 300 unique strength characteristics that alternate polygonal internal cell structures do not provide. The eight-sided chambers 322 may have a diameter, as previously described, of approximately eight inches, while the four-sided chambers 323 have a smaller diameter of four inches. The diameters of the cells or chambers of the shipping pallet 300 may be increased or decreased based on the desired characteristics of the shipping pallet. With an increased diameter of the chambers or cells, the shipping pallet will weigh let but will also be able to carry less weight. Alternatively, with a decreased diameter in the chambers or cells, the shipping pallet will weigh more but will also be able to carry more weight.

Figure 9:
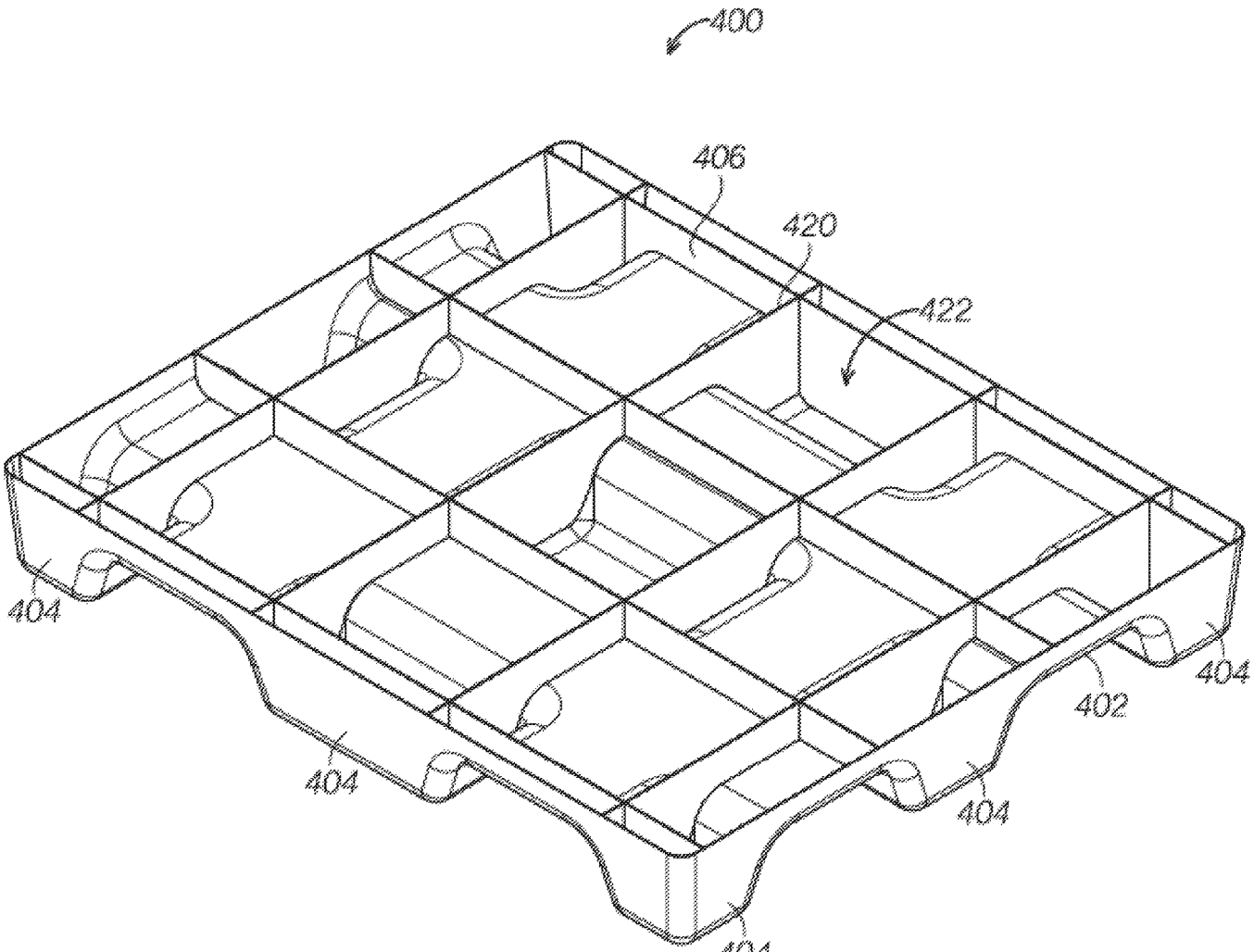
FIG. 9 is a perspective view of a fourth example of a shipping pallet including a four-sided internal cell structure.

Turning to FIG. 9, a fourth example of a shipping pallet with unique polygonal internal closed cell structures, utilizing arched filleted legs and single piece molding, shipping pallet 400, will now be described. Shipping pallet 400 functions to distribute the weight of a load placed on the shipping pallet 400 utilizing alternate chambers and partition designs. As shown in FIG. 9, shipping pallet 400 includes a base 402, legs 404, and partitions 406 or ribs 420. Shipping pallet 400 utilizes a four-sided internal cell structure to create chambers 422 that may support a load, making storage and transport of goods easy and reliable. The four-sided chambers 422 may have a diameter, as previously described, of approximately sixteen inches, which is a larger example of a diameter. A four-sided chamber 422 formed by partitions 406 or ribs 420 with a larger diameter may be desirable when a smaller or lighter load is placed on the shipping pallet. The four-sided internal cell structure of shipping pallet 400 may give the shipping pallet 400 unique characteristics and a lightness and ease of transportation that alternate polygonal internal cell structures do not provide. The decrease in partitions and larger cells may also make shipping pallet 400 lighter than an alternate polygonal internal cell structure shape.

Figure 10:
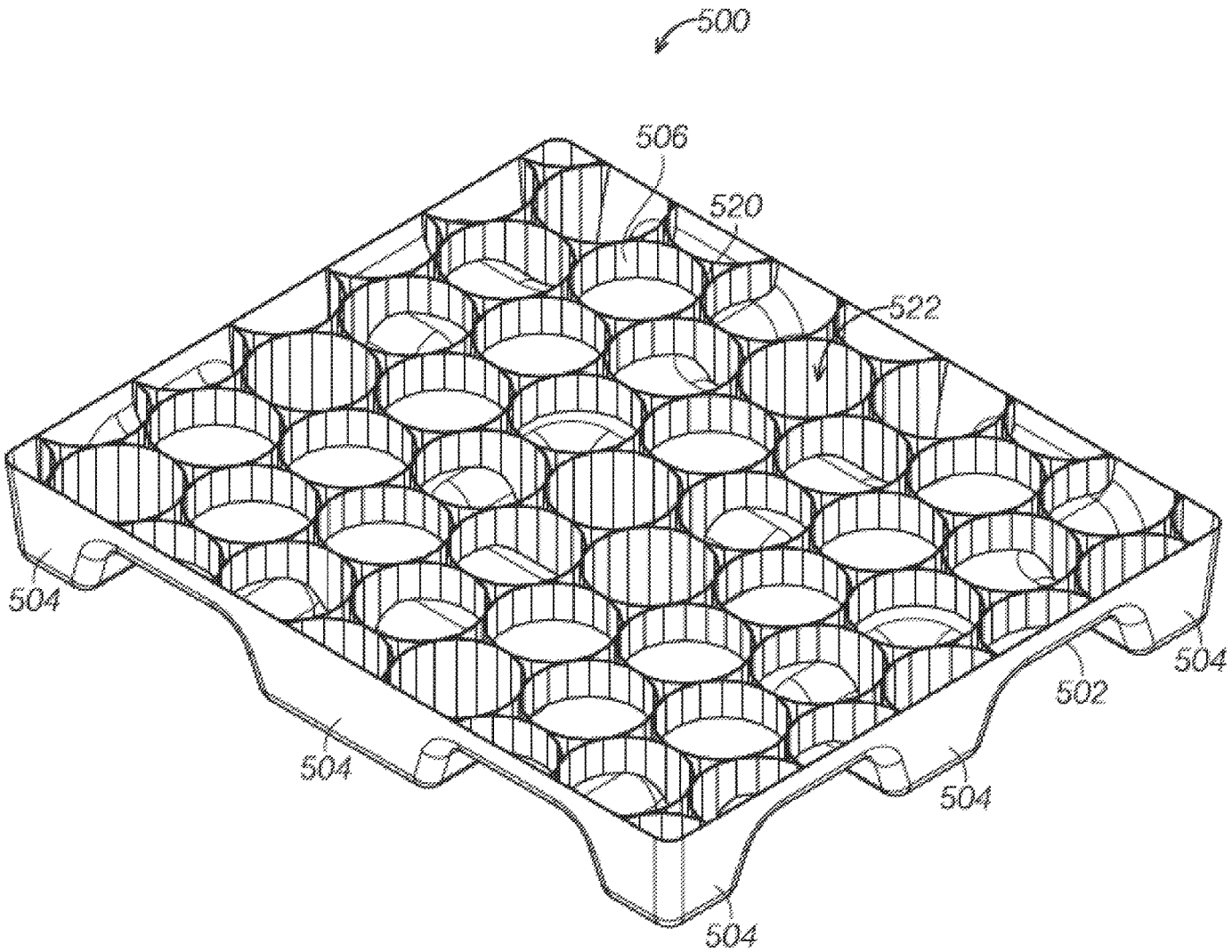
FIG. 10 is a perspective view of a fifth example of a shipping pallet including a twenty-sided internal cell structure.

Turning to FIG. 10, a fifth example of a shipping pallet with unique polygonal internal closed cell structures, utilizing arched filleted legs and single piece molding, shipping pallet 500, will now be described. Shipping pallet 500 functions to distribute the weight of a load placed on the shipping pallet 500 utilizing alternate chambers and partition designs. As shown in FIG. 10, shipping pallet 500 includes a base 502, legs 504, and partitions 506 or ribs 520. Shipping pallet 500 utilizes a twenty-sided internal cell structure to create chambers 522 that may support a load, making storage and transport of goods easy and reliable. A twenty-sided chamber 522 formed by partitions 506 or ribs 520 may give the shipping pallet 500 unique strength characteristics that alternate polygonal internal cell structures do not provide. The twenty-sided chamber 522 may be the most sides that an internal chamber may utilize. Any more sides and the chamber functions similarly to a circle, and thus could be characterized as being a circle in function.

Figure 11A:
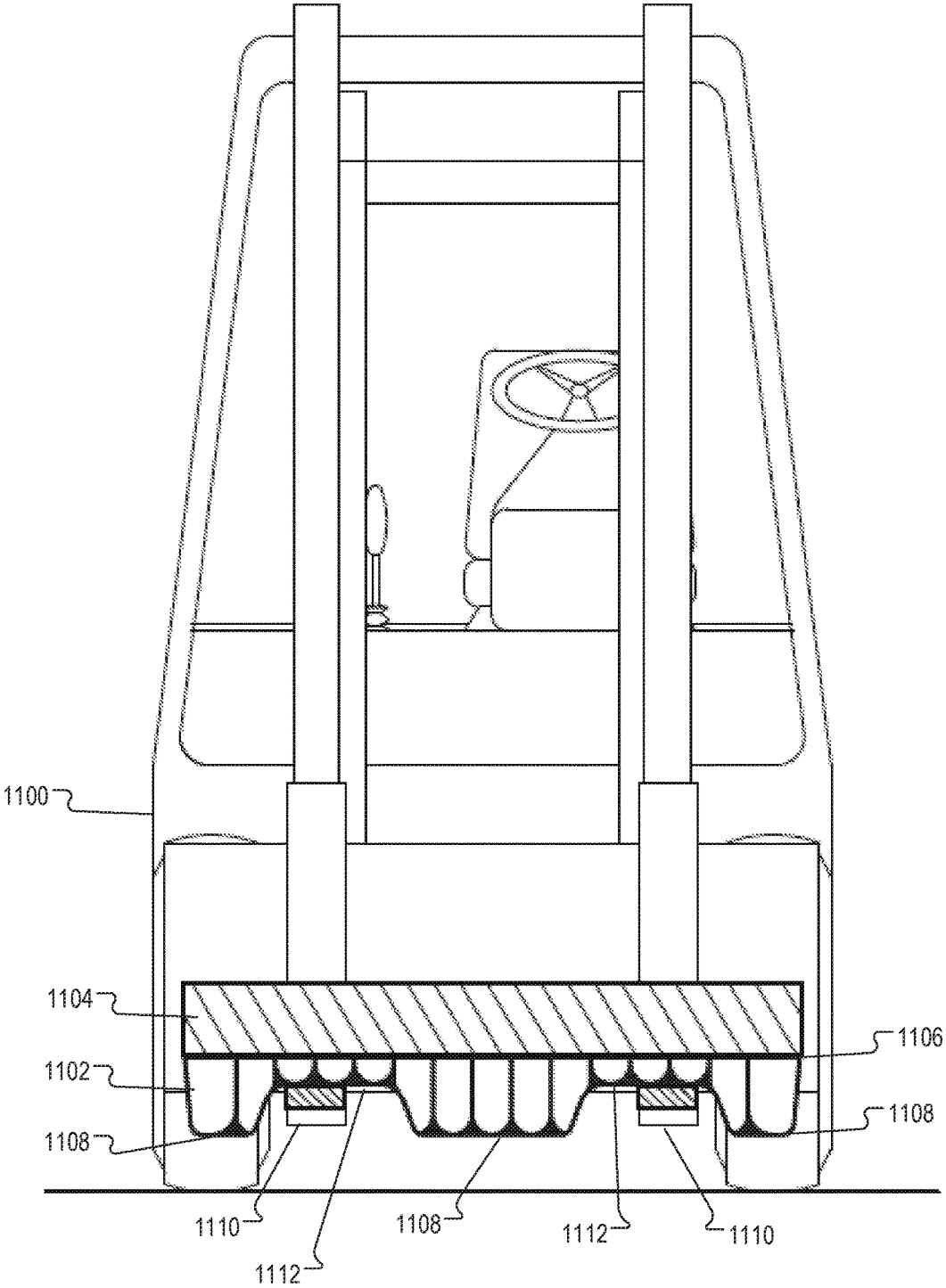
FIG. 11A illustrates a lifting device lifting a pallet load with an object, according to an embodiment.

FIG. 11A illustrates a lifting device 1100 lifting a pallet 1102 loaded with an object 1104, according to an embodiment. The lifting device 1100 may be a forklift, a pallet jack, a front loader, a work saver, a jacking device, a crane, and so forth. In one example, the lifting device 1100 may include forks 1110 that may be inserted below a portion of the pallet 1102 to raise or lower the pallet 1102 as the lifting device 1100 moves the pallet 1102.

The pallet 1102 may be a transportation structure with a relatively flat top surface 1106 configured to support and/or transport the object 1104 in a stable fashion while being lifted by the lifting device 1100. The pallet 1102 may include legs 1108 and arches 1112 between the legs 1108 configured to receive the forks 1110 of the lifting device 1100. For example, the arches 1112 may curve upwardly from the legs 1108 to form a curved portion where the forks 1110 may be inserted between the legs 1108. Once the forks 1110 are inserted, as the forks 1110 of the lifting device 1100 are raised or lowered, the pallet 1102 loaded with the object 1104 may also be raised or lowered, respectively.

Figure 11B:
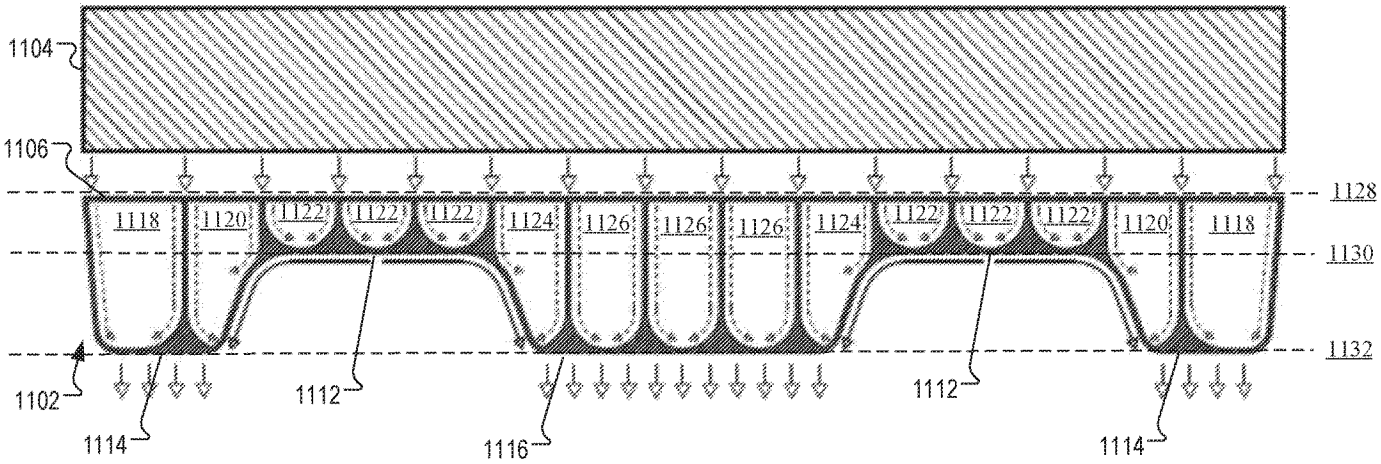
FIG. 11B illustrates the pallet with a substrate that includes outer legs, inner leg, arches, and inner chambers to disperse a downward force from the object, according to an embodiment.

FIG. 11B illustrates the pallet 1102 with a substrate that includes outer legs 1114, an inner leg 1116, arches 1112, and inner chambers 1118-1126 to disperse a downward force from the object 1104, according to an embodiment. Some of the features in FIG. 11B are the same or similar to some of the features in FIG. 11A as noted by same reference numbers, unless expressly described otherwise.

The pallet 1102 may be configured to disperse downward force from the object 1104 placed on a top surface 1106 of the pallet 1102 that extends along a first plane 1128. The downward force from the object 1104 on the first plane 1128 is shown by the hollow arrows extending downwardly from the object 1104 in FIG. 11B. In one embodiment, the structure of the pallet 1102 may include a substrate extending along a second plane 1130.

The internal structure of the pallet 1102 may also include internal chambers 1118-1126. In one embodiment, the internal chambers 1118-1126 may be inverted domes. For example, the inverted domes may each include a cylindrical chamber wall that tapers inward and downward to a bottom part of the cylindrical chamber. In one embodiment, the inverted domes may be substantially U-shaped. In one example, the U-shape may taper to an apex at the bottom of the curve. In another example, the U-shape may be flat at the bottom of the curve.

The outer legs 1114 and the inner leg 1116 may be formed by depressions in the substrate of the pallet 1102. In one embodiment, the internal structure of the pallet may include first leg chambers 1118 and second leg chambers 1120 at locations corresponding to the outer legs 1114 of the pallet 1102. The first leg chambers 1118 and the second leg chambers 1120 may be internal chambers that extend into an internal portion of the outer legs 1114. For example, the first leg chambers 1118 may be an inverted dome-shaped chamber along an outer perimeter of the pallet 1102 and an exterior portion of the outer legs 1114 that extends downwardly and inwardly from the first plane 1128 at the top surface of the device 1104 to a third plane 1132 at the bottom of the outer legs 1114. In this example, the first leg chambers 1118 may taper inwardly as they extend downward from the first plane 1128 to the third plane 1132.

In another embodiment, the second leg chambers 1120 may be inverted dome-shaped chambers along an outer perimeter of the pallet 1102 and an inner portion of the outer legs 1114 extend downwardly and inwardly from the first plane 1128 at the top surface of the pallet 1102 to the third plane 1132 at the bottom of the outer legs 1114. In this example, the second leg chambers 1120 may taper inwardly as they extend downward from the first plane 1128 to the third plane 1132.

In one embodiment, the first leg chambers 1118 and the second leg chambers 1120 may be located next to each other and both extend downwardly into the interior portion of the outer legs 1114. In another embodiment, the inverted dome shapes of the first leg chambers 1118 and/or the second leg chambers 1120 may be cylindrical. In another embodiment, the inverted dome shape of the first leg chambers 1118 and/or the second leg chambers 1120 may be partially cylindrical. For example, as the chamber wall of a second leg chamber 1120 extends downwardly a portion of the chamber wall may unevenly extend inwardly to cause the cylindrical shape to be uneven. In this example, the chamber wall may unevenly extend inwardly to accommodate the arch 1112 that extends between the outer legs 1114 and the inner leg 1116.

In another embodiment, the internal structure of the pallet 1102 may include arch chambers 1122 at a location corresponding to the arch 1112 of the pallet 1102. The arch chambers 1122 may be internal chambers that extend into an internal portion of the pallet 1102 located above the arch 1112. For example, an arch chamber 1122 may be an inverted dome-shaped chamber at an inner portion of the pallet 1102 between the outer legs 1114 and the inner leg 1116. The inverted dome shape of the arch chamber 1122 may extend downwardly and inwardly from the first plane 1128 at the top surface of the pallet 1102 to the second plane 1130 of the substrate. In this example, the arch chambers 1122 may taper inwardly as it extends downward from the first plane 1128 to the second plane 1130.

In one embodiment, the internal structure of the pallet 1102 may include one or more first interior chambers 1124 and one or more second interior chambers 1126 at a location corresponding to the inner leg 1116 of the pallet 1102. The first interior chambers 1124 and the second interior chambers 1126 may be internal chambers that extend into an internal portion of the inner leg 1116. For example, a first interior chamber 1124 may be an inverted dome-shaped chamber along an outer edge portion of the inner leg 1116 that extends downwardly and inwardly from the first plane 1128 at the top surface of the pallet 1102 to the third plane 1132 at the bottom of the inner leg 1116. In this example, the first interior chamber 1124 may taper inwardly as it extends downward from the first plane 1128 to the third plane 1132.

In another embodiment, the second interior chamber 1126 may be an inverted dome-shaped chamber along an inner portion of the inner leg 1116 that extends downwardly and inwardly from the first plane 1128 at the top surface of the pallet 1102 to the third plane 1132 at the bottom of the outer legs 1114. In this example, the second interior chamber 1126 may taper inwardly as it extends downward from the first plane 1128 to the third plane 1132.

In one embodiment, the first interior chamber 1124 and the second interior chamber 1126 may be located next to each other and both extend downwardly into the interior portion of the inner leg 1116. In another embodiment, the inverted dome shape of the first interior chamber 1124 and/or the second interior chamber 1126 may be cylindrical. In another embodiment, the inverted dome shape of the first inner chamber 1114 and/or the second interior chamber 1126 may be partially cylindrical. For example, as the chamber wall of the first interior chamber 1124 extends downwardly, a portion of the chamber wall may unevenly extend inwardly to cause the cylindrical shape to be uneven. In this example, the chamber wall may unevenly extend inwardly to accommodate the arch 1112 that extends between the outer legs 1114 and the inner leg 1116.

As discussed above, the pallet 1102 may be configured to disperse downward force from the object 1104 placed on the top surface 1106 of the pallet 1102 that extends along the first plane 1128. The downward force from the object 1104 on the first plane 1128 may initially be placed on the inner chambers 1118-1126. As the downward force from the object 1104 is placed on the inner chambers 1118-1126, the inverted dome shapes of each of the inner chambers 1118-1126 may direct the downward force toward a bottom center area of each of the inverted domes of the inner chamber 1118-1126, as shown by the hollow arrows in FIG. 11B.

As the downward force is directed to the bottom center of each of the inverted domes of the inner chambers 1118-1126, the downward force may be focused at the bottom center area of each of the inner chambers 1118-1126. The focused downward force is then dispersed downwardly and outwardly by the corresponding arches 1112, outer legs 1114, and inner leg 1116 so that the downward force is equally dispersed across the lifting device 1100 and to the ground. The dispersed force may reduce a weight of the device 1100 and increase an amount of weight that the lifting device 1100 may hold by providing a structure that disperses the force so that the weight to strength ratio is increased.

In one example, as a downward force is applied from the object 1104 onto the arch chambers 1122, the corresponding arch 1112 may disperse the downward force from the arch chambers 1122 downward toward the ground and outwardly toward the outer legs 1114 and inner leg 1116. In one example, an arch 1112 may disperse the downward force from the arch chambers 1122 equally between an outer leg 1114 and an inner leg 1116.

In another example, as the downward force is applied from the object 1104 onto the first leg chambers 1118 and the second leg chambers 1120, the corresponding outer legs 1114 may disperse the downward force from the first leg chambers 1118 and the second leg chambers 1120 downward toward the ground and outwardly along the bottom surface of the outer legs 1114 along the third plane 1132. In another example, as the downward force is applied from the object 1104 onto the first interior chambers 1124 and the second interior chambers 1126, the corresponding inner leg 1116 may disperse the downward force from the first interior chambers 1124 and the second interior chambers 1126 downward toward the ground and outwardly along the bottom surface of the inner leg 1116 at the third plane 1132. In another example, an upward force may be reversely applied from the outer legs 1114 and an inner leg 1116 to the chambers 1118-1126. For example, when upward pressure is applied to the outer legs 1114 and/or the inner legs 1116, the upward force may be focused by the outer legs 1114 and/or the inner legs 1116 toward the bottom of the chambers 1118-1126. The chambers 1118-1126 may then disperse the force across the top surface of the pallet 1102.

Figure 11C:
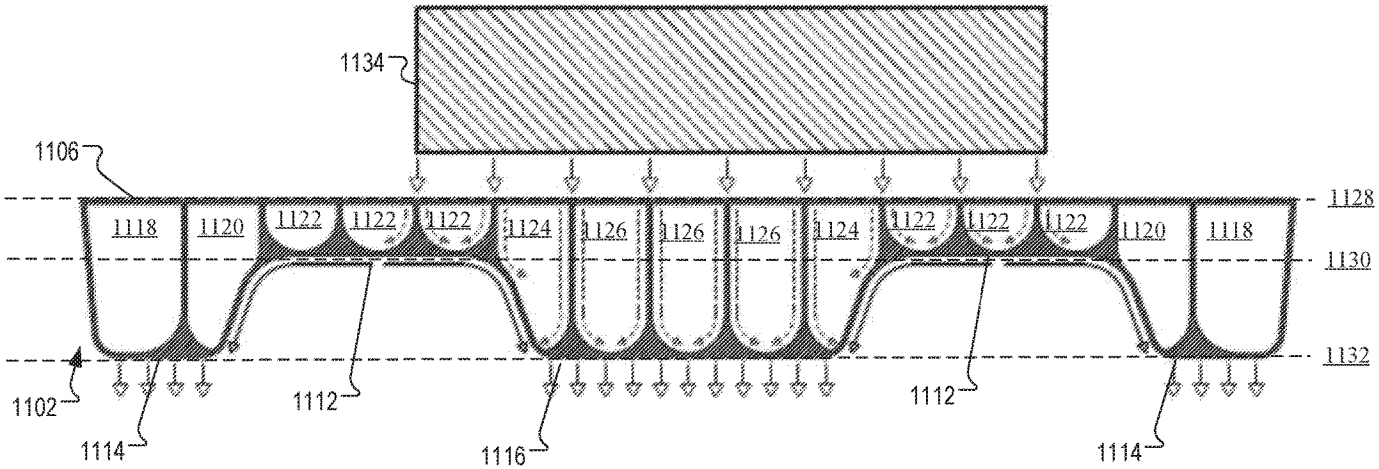
FIG. 11C illustrates the pallet with an object applying a downward force to part of the pallet, according to an embodiment.

FIG. 11C illustrates the pallet 1102 with an object 1134 applying downward force to part of the pallet 1102, according to an embodiment. Some of the features in FIG. 11C are the same or similar to some of the features in FIGS. 11A-11B as noted by same reference numbers, unless expressly described otherwise. As discussed above, when the object 1104 in FIG. 11B applies downward force across the entire surface of the pallet 1102, the pallet 1102 is configured to disperse the downward force across the pallet 1102. In another example, the object 1134 may apply a downward force to only a portion of the top surface 1106 of the pallet 1102. For example, as the size of the object 1134 (such as a width and/or a length) may be smaller than a size of the top surface 1106 of the pallet 1102, the object 1134 may only apply the downward force to the portion of the top surface 1106 that the object 1134 covers.

When the object 1134 only applies the downward force to the portion of the top surface 1106, the pallet 1102 may be configured to disperse the downward force across at least a portion of the pallet 1102. For example, the object 1134 may be placed at a center of the pallet 1102 and apply downward force on the first plane 1128 to one or more of the arch chambers 1122, the first interior chambers 1124, and the second interior chambers 1126. As the downward force from the object 1134 is placed on the inner chambers 1122-1126, the inverted dome shapes of each of the inner chambers 1122-1126 may direct the downward force toward a bottom center of each of the inverted domes of the inner chamber 1122-1126, as shown by the hollow arrows in FIG. 11C. In one embodiment, the inverted domes may be substantially U-shaped. In one example, the U-shape may taper to an apex at the bottom of the curve. In another example, the U-shape may be flat at the bottom of the curve.

As the downward force is directed to the bottom center of each of the inverted domes of the inner chambers 1122-1126, the downward force is focused at the bottom center of each of the inner chambers 1111-1126. The focused downward force may be dispersed downwardly and outwardly by the corresponding arches 1112, outer legs 1114, and inner leg 1116 so that the downward force is equally dispersed across the pallet 1102 and to the ground. In one example, as a downward force is applied from the object 1134 onto the arch chambers 1122 where the object 1134 rests, the corresponding arches 1112 may disperse the downward force from the arch chambers 1122 downwardly toward the ground and outwardly toward the outer legs 1114 and inner leg 1116. In another example, as the downward force is applied from the object 1134 onto the first interior chambers 1124 and the second interior chambers 1126, the corresponding inner leg 1116 may disperse the downward force from the first interior chambers 1124 and the second interior chambers 1126 downward toward the ground and outwardly along the bottom surface of the inner leg 1116 along the third plane 1132. The size of the object 1104 in FIGS. 11A-B and/or the object 1134 in FIG. 11C is not intended to be limiting. For example, the object may cover a single inner chamber 1118-1126, multiple inner chambers 1118-1126, or all of the inner chambers 1118-1126. The pallet 1102 is configured to disperse the downward force applied by the objects as they vary in size, shape, and/or weight.

Figure 12:
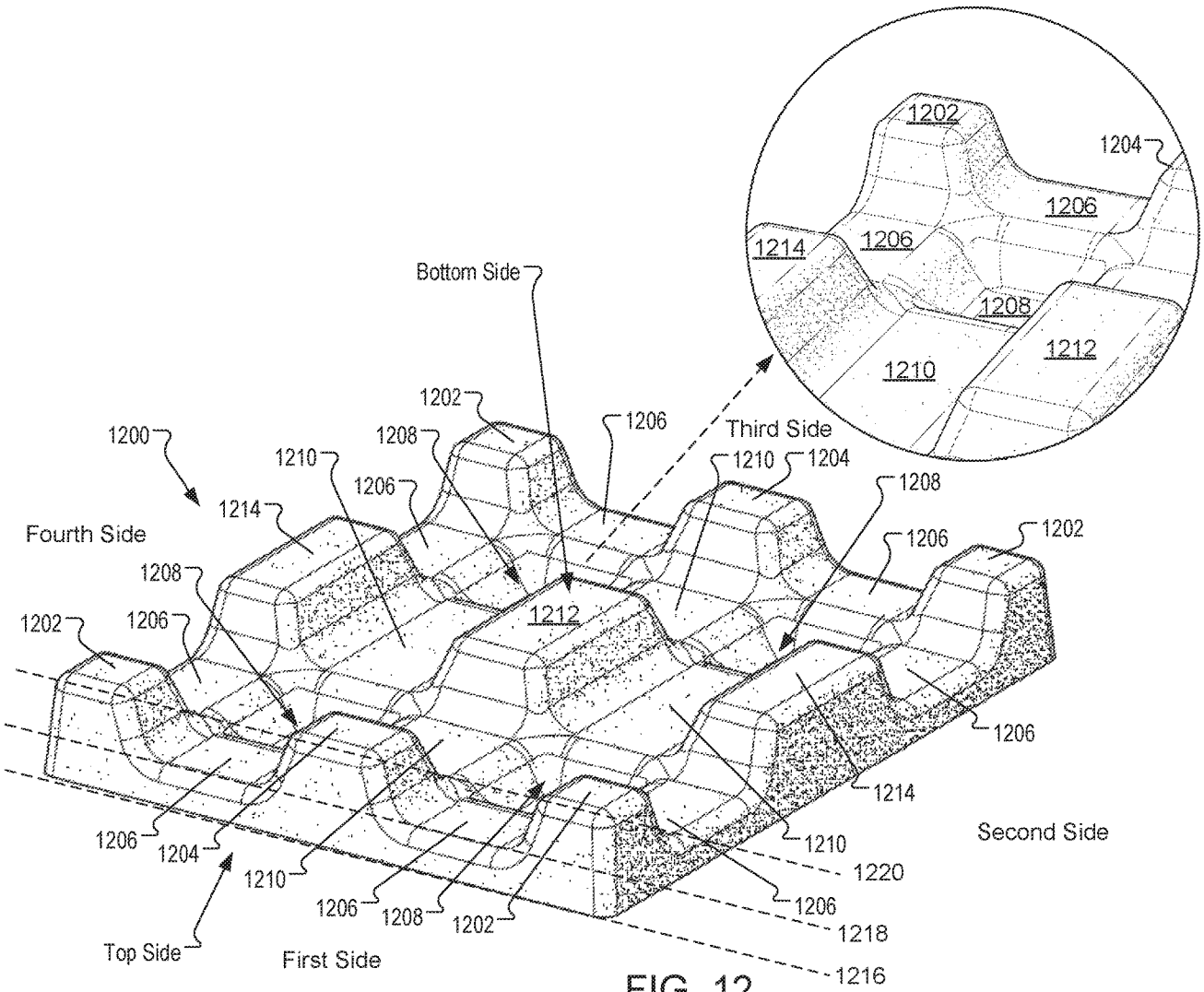
FIG. 12 illustrates a bottom view of a pallet, according to an embodiment.

FIG. 12 illustrates a bottom view of a pallet 1200, according to an embodiment. The pallet 1200 may be configured with legs, arches, and domes to disperse weight applied to a top surface of the pallet 1200. As discussed below, the legs, arches, and domes may be formed by depressions into the pallet 1200. The pallet 1200 may include corner legs 1202, first perimeter legs 1204, second perimeter legs 1214, and an inner leg 1212.

The corner legs 1202 may be located the corners of the pallet 1200. In one example, each of the corner legs 1202 may be dome shaped with a flat top. In one embodiment, the corner legs 1202 may reach from a first horizontal plane 1216 extending along a top surface of the pallet 1200 to a third horizontal plane 1220 extending along a bottom surface of the pallet 1200. In one example, the corner legs 1202 may include walls that taper inwardly as they extend from the first horizontal plane 1216 to the third horizontal plane 1220. The walls of the corner legs 1202 may taper inwardly until they reach the third horizontal plane 1220 where the walls then flatten out along the bottom surfaces of the corner legs 1202 and along the third horizontal plane 1220 to form bases of the corner legs 1202. In another example, a first wall or portion of the wall of a corner leg 1202 may extend from the first horizontal plane 1216 to the third horizontal plane 1220 and a second wall or a portion of a wall of the corner leg 1202 may extend from a second horizontal plane 1218 (located between the first horizontal plane 1216 and the third horizontal plane 1220) to the third horizontal plane 1220.

In another embodiment, the first perimeter legs 1204 may be located along a first side and/or a third side of the pallet 1200 between the corner legs 1202. Each of the first perimeter legs 1204 may be dome shaped with flat tops. For example, the first perimeter legs 1204 may extend from the first horizontal plane 1216 to the third horizontal plane 1220. In one example, the first perimeter legs 1204 may include walls that taper inwardly as they extend from the first horizontal plane 1216 to the third horizontal plane 1220. The walls of the first perimeter legs 1204 may taper inwardly until they reach the third horizontal plane 1220 where the walls then flatten out along a bottom surface of the first perimeter legs 1204 and along the third horizontal plane 1220 to form bases of the first perimeter legs 1204. In another example, a first wall or a portion of a wall of the first perimeter legs 1204 may extend from the first horizontal plane 1216 to the third horizontal plane 1220 and a second wall or a portion of a wall of the first perimeter legs 1204 may extend from the second horizontal plane 1218 to the third horizontal plane 1220.

In another embodiment, the second perimeter legs 1214 may be located along a second side and/or a fourth side of the pallet 1200 between the corner legs 1202. Each of the second perimeter legs 1214 may be dome shaped with a flat top. For example, the second perimeter legs 1214 may extend from the first horizontal plane 1216 to the third horizontal plane 1220. In one example, the second perimeter legs 1214 may include walls that taper inwardly as they extend from the first horizontal plane 1216 to the third horizontal plane 1220. The walls of the second perimeter legs 1214 may taper inwardly until they reach the third horizontal plane 1220 where the walls then flatten out along a bottom surface of the second perimeter legs 1214 and along the third horizontal plane 1220 to form bases of the second perimeter legs 1214. In one embodiment, the first perimeter legs 1204 and the second perimeter legs 1214 may be the same or similar shapes, such as square or rectangular shaped legs with walls that taper inwardly toward the third horizontal plane 1220. In another example, a first wall or a portion of a wall of the second perimeter legs 1214 may extend from the first horizontal plane 1216 to the third horizontal plane 1220 and a second wall or a portion of a wall of the second perimeter legs 1214 may extend from the second horizontal plane 1218 to the third horizontal plane 1220. In another embodiment, the first perimeter legs 1204 and the second perimeter legs 1214 may be different shapes. For example, the first perimeter legs 1204 may be square shaped legs with walls that taper inwardly toward the third horizontal plane 1220 and the second perimeter legs 1214 may be rectangular shaped legs with walls that taper inwardly toward the third horizontal plane 1220.

In another embodiment, the inner leg 1212 may be located at a center of the pallet 1200. For example, the inner leg 1212 may be equidistance from the corner legs 1202, the first perimeter legs 1204, and the second perimeter legs 1214. The inner leg 1212 may be dome shape with a flat top. For example, the inner leg 1212 may extend from the second horizontal plane 1218 to the third horizontal plane 1220. In one example, the inner leg 1212 may include walls that taper inwardly as they extend from the second horizontal plane 1218 to the third horizontal plane 1220. The walls of the inner leg 1212 may taper inwardly until they reach the third horizontal plane 1220 where the walls then flatten out along a bottom surface of the inner leg 1212 and along the third horizontal plane 1220 to form a base of the inner leg 1212.

In another embodiment, the pallet 1200 may include intermediate portions that extend between the corner legs 1202, the first perimeter legs 1204, the second perimeter legs 1214, and the inner leg 1212. The intermediate portions may include the first arches 1206 and the second arches 1210. In one example, each of the first arches 1206 may extend between one of the corner legs 1202 and one of the first perimeter legs 1204 or the second perimeter legs 1214. The first arches 1206 may be curved structures of the pallet 1200 that curve downwardly from the second horizontal plane 1218 to the third horizontal plane 1220. In another example, each of the second arches 1210 may extend between one of the first perimeter legs 1204 or the second perimeter legs 1214 and the inner leg 1212. The second arches 1210 may be curved structures of the pallet 1200 that curve downwardly from the second horizontal plane 1218 to the third horizontal plane 1220.

In one embodiment, a side wall of a corner leg 1202 may taper downward toward a first edge of the arch 1206 and a side wall of a first perimeter leg 1204 or second perimeter leg 1214 may taper downward toward a second edge of the first arch 1206. The side wall of the corner legs 1202, the side wall of the first perimeter leg 1204 or the second perimeter leg 1214, and a middle or intermediate portion between the side walls may form a first arch 1206. In another embodiment, a side wall of the inner leg 1212 may taper downward toward a first edge of the second arch 1210 and a side wall of a first perimeter leg 1204 or a second perimeter leg 1214 may taper downward toward a second edge of the second arch 1210. The side wall of the inner leg 1212, the side wall of the first perimeter leg 1204 or the second perimeter leg 1214, and a middle or intermediate portion between the side walls may form a second arch 1210.

As discussed above, the first arches 1206 and/or the second arches 1210 may aid in dispersing downward pressure from an object placed on the top surface of the pallet 1200. The first arches 1206 and/or the second arches 1210 may also provide openings to receive the arms or forks of a lifting device, such as the lifting device 1100 in FIG. 11A.

In another embodiment, the pallet 1200 may include domes 1208 that each extend between a corner leg 1202, a first perimeter leg 1204, a second perimeter leg 1214, the inner leg 1212, a first arch 1206 between a corner leg 1202 and a first perimeter leg 1204, another first arch 1206 between a corner leg 1202 and a second perimeter leg 1214, a second arch 1210 between the center leg 1212 and a first perimeter leg 1204, and another second arch 1210 between the inner leg 1212 and a second perimeter leg 1214.

In one embodiment, a corner of the corner legs 1202 may taper upwardly toward a first corner of one of the domes 1208, a corner of a first perimeter leg 1204 may taper upwardly toward a second corner of the dome 1208, a corner of a second perimeter leg 1214 may taper upwardly toward a third corner of the dome 1208, and a corner of the inner leg 1212 may taper upwardly toward a fourth corner of the dome 1208. In another embodiment, one or more of the domes 1208 may taper inwardly from the second horizontal plane 1218 to the first horizontal plane 1216. In another embodiment, one or more of the domes 1208 may taper inwardly from the second horizontal plane 1218 to a defined distance below the first horizontal plane 1216. In one example, a dome 1208 may include a cylindrical chamber wall that tapers inward and upwardly toward the top side of the pallet 1200.

The size, shape, number, and location of the corner legs 1202, the first perimeter legs 1204, the second perimeter legs 1214, the inner leg 1212, the first arches 1206, the second arches 1210, and the domes 1208 are not intended to be limiting. In one example, the corner legs 1202, the first perimeter legs 1204, the second perimeter legs 1214, the inner leg 1212, the first arches 1206, the second arches 1210, and/or the domes 1208 may be square shaped. In another example, the corner legs 1202, the first perimeter legs 1204, the second perimeter legs 1214, the inner leg 1212, the first arches 1206, the second arches 1210, and/or the domes 1208 may be rectangular shaped. In another example, the corner legs 1202, the first perimeter legs 1204, the second perimeter legs 1214, the inner leg 1212, the first arches 1206, the second arches 1210, and/or the domes 1208 may be cylindrical shaped. In another example, the edges of the corner legs 1202, the first perimeter legs 1204, the second perimeter legs 1214, the inner leg 1212, the first arches 1206, the second arches 1210, and/or the domes 1208 may be straight. In another example, the edges of the corner legs 1202, the first perimeter legs 1204, the second perimeter legs 1214, the inner leg 1212, the first arches 1206, the second arches 1210, and/or the domes 1208 may be rounded or curved. In another example, the corner legs 1202, the first perimeter legs 1204, the second perimeter legs 1214, the inner leg 1212, the first arches 1206, the second arches 1210, and/or the domes 1208 may be uniformly shaped. In another example, one or more of the corner legs 1202, the first perimeter legs 1204, the second perimeter legs 1214, the inner leg 1212, the first arches 1206, the second arches 1210, and/or the domes 1208 may have different shapes.

Figure 13A:
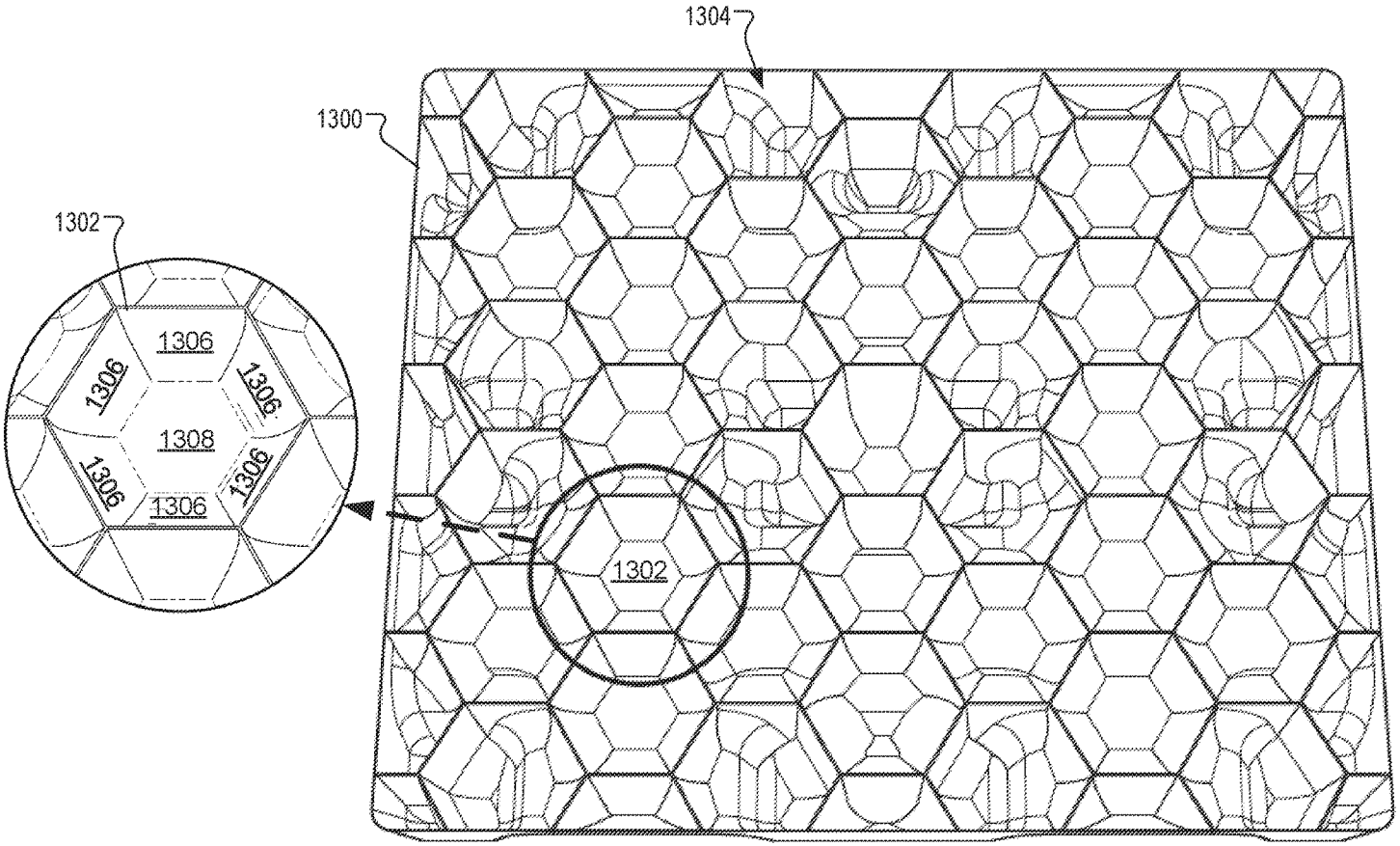
FIG. 13A illustrates a top view of the pallet with inner chambers, according to an embodiment.

FIG. 13A illustrates a top view of the pallet 1300 with inner chambers 1302, according to an embodiment. FIG. 13A includes a reference number pointing to one of the inner chambers 1302 of the pallet 1300 for ease of explanation and clarity in the drawings, however, the pallet 1300 may include a rib structure 1304 with multiple inner chambers 1302 without the reference number 1302 pointing to each of them, as shown in FIG. 13A. For example, the pallet 1300 may include a rib structure 1304 with multiple inner chambers 1302 in a uniform pattern. The uniform pattern may include portions of the inner chambers 1302 along the edges or outer perimeter of the pallet 1300, where a portion of the inner chamber 1302 is cut off to form the edge or outer perimeter of the pallet 1300 while the remaining portion of the inner chamber 1302 is the same as corresponding complete inner chambers 1302.

In one embodiment, an inner chamber 1302 may have an inverted dome shape. The inverted dome shape may include one or more chamber walls 1306. For example, the inner chamber 1302 may be a single chamber wall 1306 that is a cylindrical dome that tapers downwardly from a top surface of the pallet 1300 to form an inverted dome with a rounded vault 1308 at a bottom of the cylindrical dome. In another example, the inner chamber 1302 may include multiple chamber walls 1306 that are connected together to form the inverted dome with the rounded vault 1308.

In one embodiment, the inverted domes may be substantially U-shaped. In one example, the U-shape may taper to an apex at the bottom of the curve. In another example, the U-shape may be flat at the bottom of the curve. The shape of the inner chambers 1302 is not intended to be limiting. For example, the inner chambers 1302 may be rectangularly shaped, square shaped, or other polygonal shapes with tapered walls that extend downwardly to a vault at the bottom of the dome.

Figure 13B:
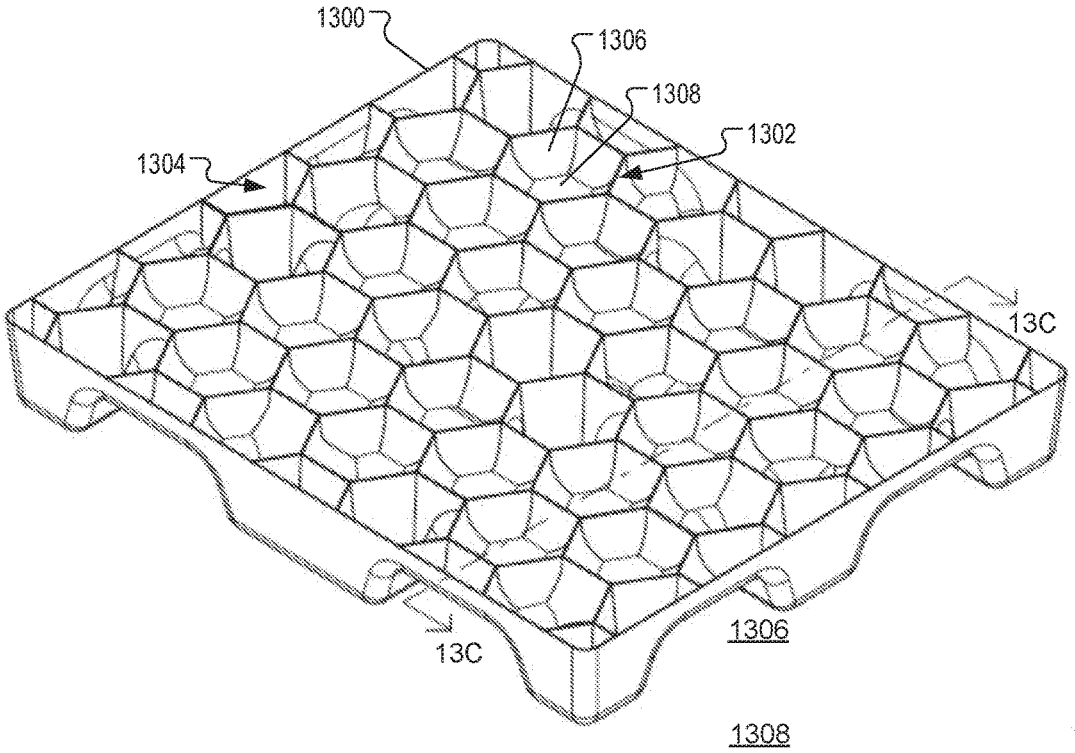
FIG. 13B illustrates a side perspective view of the pallet in FIG. 13A, according to an embodiment.

FIG. 13B illustrates a side perspective view of the pallet 1300 in FIG. 13A, according to an embodiment. Some of the features in FIG. 13B are the same or similar to some of the features in FIG. 13A as noted by same reference numbers, unless expressly described otherwise. As discussed above, the pallet may include legs or portions of legs that may extend from a first horizontal plane at a top surface of the pallet 1300 to a third horizontal plane at a bottom surface of the pallet 1300 or a second horizontal plane between the first horizontal plane and the third horizontal plane (as shown in FIGS. 11A-12). For example, as the legs or portions of legs form depressions in the pallet 1300, the legs or portions of legs may include hollow inner portions.

In one example, an inner chamber 1302 may include a first portion of the first chamber wall extends from the first horizontal plane at the top surface of the pallet 1300 to a second horizontal plane at a middle portion of the pallet 1300. The inner chamber 1302 may also include a second portion that extends from the first horizontal plane along an inner wall of a hollow leg so that it transitions from the second horizontal plane to a third horizontal plane at the bottom surface of the pallet 1300 and at a bottom portion of the hollow leg. The inner chamber 1302 may also include a third portion that extends from the first horizontal plane to the third horizontal plane. The first portion of the inner chamber 1302, the second portion of the inner chamber 1302, and the third portion of the inner chamber 1302 may form a chamber wall that extends along the second horizontal plane where a leg is not located and then extends down into the hollow portion of the leg to maintain the inverted dome within the hollow portion of the leg, as shown in FIG. 11B.

In another example, the chamber walls 1306 of the inner chambers 1302 may extend upwardly and/or downwardly to conform to one or more of the legs 1202, 1204, 1214 in FIG. 12, the arches 1206 and 1210 in FIG. 12, and/or the domes 1208 in FIG. 12. In one example, a uniform polygonal pattern of the rib structure 1304 may refer to the cylindrical or polygonal shape of the inner chambers 1302 as viewed from a top view where the top edges of the chamber walls 1306 from uniform cylindrical or polygonal shapes and the chamber walls 1306 may extend into the legs 1202, 1204, 1214 in FIG. 12, the arches 1206 and 1210 in FIG. 12, and/or the domes 1208 in FIG. 12 at various depths.

Figure 13C:
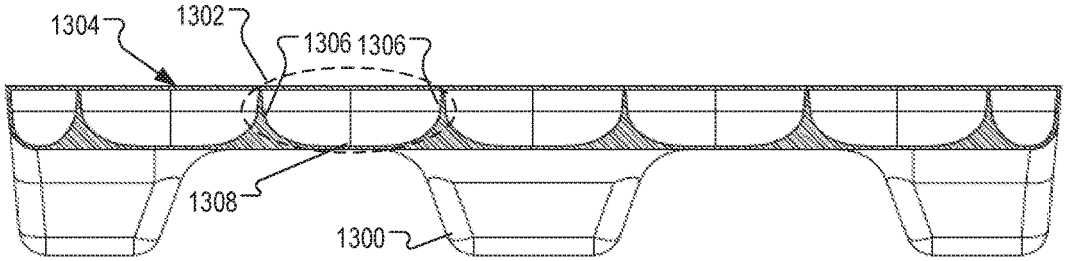
FIG. 13C illustrates an exposed side view of the pallet in FIG. 13A, according to an embodiment.

FIG. 13C illustrates an exposed side view of the pallet 1300 in FIG. 13A, according to an embodiment. Some of the features in FIG. 13C are the same or similar to some of the features in FIGS. 13A and 13B as noted by same reference numbers, unless expressly described otherwise. As discussed above, the chamber walls 1306 of the inner chambers 1302 may extend upwardly and/or downwardly to conform to one or more of the legs 1202, 1204, 1214 in FIG. 12, the arches 1206 and 1210 in FIG. 12, and/or the domes 1208 in FIG. 12. In one embodiment, the uniform polygonal pattern of the rib structure 1304 may refer to inner chambers 1302 that may not extend into the legs 1202, 1204, 1214 in FIG. 12, the arches 1206 and 1210 in FIG. 12, but rather extend from the first horizontal plane to the second horizontal plane to form inner chambers 1302 with uniform polygonal shapes and chamber walls 1306 that extend to uniform depths in the pallet 1300. For example, each of the inner chambers 1302 may extend from the top surface of the pallet 1300 to a defined depth above the bottom surface of the pallet 1300. In one example, the defined depth may be at a depth that is above a height that the legs 1202, 1204, 1214 in FIG. 12, the arches 1206 and 1210 in FIG. 12, and/or the domes 1208 in FIG. 12 extend into the pallet 1200 from the bottom surface of the pallet 1200. In another example, the defined depth may be a defined depth below the top surface of the pallet 1300, such as a depth between 1 millimeter (mm) and 20 mm. In another example, the defined depth may vary based on a size of the pallet 1300. In one embodiment, when the pallet 1300 is relatively small, the defined depth may be shallower than a pallet that is relatively large. In one example, a relatively small pallet may be less than or equal to 1.5 meters in width, 2.5 meter in length, and 0.3 meters in depth and a relatively large pallet may be greater than 1.5 meter in width, 2.5 meter in length, and 0.3 meters in depth. In another example, a relatively small pallet may be less than or equal to 1 meter in width, 1 meter in length, and 0.2 meters in depth and a relatively large pallet may be greater than 1 meter in width, 1 meter in length, and 0.2 meters in depth.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and sub-combinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and sub-combinations of the disclosed inventions that are believed to be novel and non-obvious. Inventions embodied in other combinations and sub-combinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. An apparatus, comprising:

a substrate extending along a first plane;

a first leg formed from a first depression in the substrate; the first leg protruding downwardly from the first plane to a second plane to form a first inverted dome, wherein:

the first plane and the second plane are substantially parallel to each other; and the first inverted dome is a first U-shaped dome that tapers to an apex at a bottom of an inward curve of the first U-shaped dome;

a second leg formed from a second depression in the substrate, the second leg protruding downwardly from the first plane of the substrate to the second plane to form a second inverted dome, wherein the second inverted dome is a second U-shaped dome that tapers to an apex at a bottom of an inward curve of the second U-shaped dome;

an intermediate portion located between the first leg and the second leg, the intermediate portion protruding upwardly from the second plane of the substrate to the first plane to form an arch between the first leg and the second leg; and a rib structure disposed at an interior portion of the substrate, the rib structure comprising:

a first chamber extending downwardly from a third plane to the first plane to form a third inverted dome, wherein:

the third inverted dome is a third U-shaped dome that tapers to an apex at a bottom of an inward curve of the third U-shaped dome; and the third inverted dome is configured to direct downward pressure applied to a top portion of the first chamber to the apex at the bottom of the third inverted dome; and a second chamber extending downwardly from the third plane to the first plane to form a fourth inverted dome, wherein:

the fourth inverted dome is a fourth U-shaped dome that tapers to an apex at a bottom of an inward curve of the fourth U-shaped dome;

the fourth inverted dome is configured to direct downward pressure applied to a top portion of the second chamber to the apex at the bottom of the fourth inverted dome; and the intermediate portion is configured to disperse the downward pressure from the apex of the third inverted dome and the fourth inverted dome toward at least one of the first leg or the second leg.

2. The apparatus of claim 1, wherein the rib structure further comprises a third chamber extending downwardly from the third plane to the second plane to form a fifth inverted dome.

3. The apparatus of claim 2, wherein the third chamber extends at least partially into a hollow inner portion of the first leg.

4. The apparatus of claim 2, wherein the third chamber extends at least partially into a hollow inner portion of the second leg.

5. The apparatus of claim 1, wherein:

the first leg is located along an outer perimeter of the substrate; and the second leg is located at an inner portion of the substrate.

6. The apparatus of claim 5, wherein the first inverted dome of the first leg comprises:

a base that extends along the second plane;

a first chamber wall located at the outer perimeter of the substrate, the first chamber extending from the third plane downwardly to the second plane to connect to a first edge of the base; and a second chamber wall located at the inner portion of the substrate, the second chamber extending from the first plane downwardly to the second plane to connect to a second edge of the base, wherein the base, the first chamber wall, and the second chamber wall form the first inverted dome of the first leg.

7. The apparatus of claim 5, wherein the second inverted dome of the second leg comprises:

a base that extends along the second plane;

a first chamber wall located at a first part of the inner portion of the substrate, the first chamber extending from the first plane downwardly to the second plane to connect to a first edge of the base; and a second chamber wall located at a second part of the inner portion of the substrate, the second chamber extending from the first plane downwardly to the second plane to connect to a second edge of the base, wherein the base, the first chamber wall, and the second chamber wall form the second inverted dome of the second leg.

8. The apparatus of claim 1, wherein:

the first chamber is configured to direct downward pressure applied to the top portion of the first chamber to approximately a first center area at the bottom of the third inverted dome, the first center area corresponding to a first area along the intermediate portion;

the second chamber is configured to direct downward pressure applied to the top portion of the second chamber to approximately a second center area at the bottom of the fourth inverted dome, the second center area corresponding to a second area along the intermediate portion; and the intermediate portion is configured to disperse the downward pressure at the first area of the first chamber and the second area of the first chamber outwardly toward at least one of the first leg or the second leg.

9. The apparatus of claim 8, wherein the intermediate portion disperses the downward pressure from the first center area and the second center area approximately equally between the first leg and the second leg.

10. The apparatus of claim 1, wherein the rib structure further comprises a third chamber extending downwardly from the third plane to the second plane to form a fifth inverted dome at an interior portion of the first leg, wherein:

the first chamber is configured to direct downward pressure applied to a top portion of the first chamber to approximately a first center area at a bottom of the third inverted dome, the first center area corresponding to a first area along the intermediate portion;

the second chamber is configured to direct downward pressure applied to a top portion of the second chamber to approximately a second center area at a bottom of the fourth inverted dome, the second center area corresponding to a second area along the intermediate portion;

the third chamber is configured to direct downward pressure applied to a top portion of the third chamber to approximately a third center area at a bottom of the fifth inverted dome, the third center area corresponding to an area along the first leg;

the intermediate portion is configured to disperse the downward pressure at the first area of the first chamber and the second area of the second chamber outwardly toward at least one of the first leg or the second leg; and the first leg is configured to disperse the downward pressure at the third center area of the third chamber along a base of the first leg.

11. The apparatus of claim 1, wherein the apparatus is a shipping pallet.

12. An apparatus, comprising:

a substrate extending along a first plane;

a first leg formed from a first depression in the substrate, the first leg protruding downwardly from the first plane of the substrate to a second plane to form a first inverted dome, wherein the first inverted dome is a first U-shaped dome that tapers to an apex at a bottom of an inward curve of the first U-shaped dome;

a second leg formed from a second depression in the substrate, the second leg protruding downwardly from the first plane of the substrate to the second plane to form a second inverted dome, wherein the second inverted dome is a second U-shaped dome that tapers to an apex at a bottom of an inward curve of the second U-shaped dome;

a third leg formed from a third depression in the substrate, the third leg protruding downwardly from the first plane of the substrate to the second plane to form a third inverted dome, wherein the third inverted dome is a third U-shaped dome that tapers to an apex at a bottom of an inward curve of the third U-shaped dome;

a fourth leg formed from a fourth depression in the substrate, the second leg protruding downwardly from the first plane of the substrate to the second plane to form a fourth inverted dome, wherein the fourth inverted dome is a fourth U-shaped dome that tapers to an apex at a bottom of an inward curve of the fourth U-shaped dome;

an intermediate portion extending along the first plane and connecting to the first leg and the second leg; and a dome portion centrally located between a corner of the first leg, a corner of the second leg, a corner of the third leg, and a corner of the fourth leg, wherein the dome portion extends upwardly from the first plane to a third plane.

13. The apparatus of claim 12, wherein:

a side wall of the first leg tapers downwardly toward a first edge of the intermediate portion; and a side wall of the second leg tapers downwardly toward a second edge of the intermediate portion, wherein the side wall of the first leg, the side wall of the second leg, and the intermediate portion form an arch extending downwardly from the second plane to the first plane.

14. The apparatus of claim 12, wherein:

the corner of the first leg tapers upwardly toward a first corner of the dome portion;

the corner of the second leg tapers upwardly toward a second corner of the dome portion;

the corner of the third leg tapers upwardly toward a third corner of the dome portion; and the corner of the fourth leg tapers upwardly toward a fourth corner of the dome portion.

15. The apparatus of claim 14, wherein the corner of the first leg, the corner of the second leg, the corner of the third leg, the corner of the fourth leg, and the dome portion form a dome that extends upwardly from the second plane to the third plane.

16. An apparatus, comprising:

a substrate; and a rib structure disposed at an interior portion of the substrate, the rib structure comprising:

a first chamber extending downwardly from a first plane to a second plane, wherein:

a first wall of the first chamber tapers inwardly to form a first inverted dome; and the first inverted dome is a first U-shaped dome that tapers to an apex at a bottom of an inward curve of the first U-shaped dome; and a second chamber extending downwardly from the first plane to the second plane, wherein:

a second wall of the second chamber tapers inwardly to form a second inverted dome; and the second inverted dome is a second U-shaped dome that tapers to an apex at a bottom of an inward curve of the second U-shaped dome.

17. The apparatus of claim 16, wherein:

the first chamber comprises a first polygonal base tapering into a first rounded vault; and the second chamber comprises a second polygonal base tapering into a second rounded vault.

18. The apparatus of claim 16, wherein the first chamber and the second chamber from a substantially uniform polygonal pattern.

* * * * *